US006991389B2

(12) United States Patent
Mochizuki et al.

(10) Patent No.: US 6,991,389 B2
(45) Date of Patent: Jan. 31, 2006

(54) FOLDABLE KEYBOARD

(75) Inventors: Isao Mochizuki, Kaizu-gun (JP); Takeyuki Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 94 days.

(21) Appl. No.: 10/797,546

(22) Filed: Mar. 11, 2004

(65) Prior Publication Data

US 2004/0190230 A1 Sep. 30, 2004

(30) Foreign Application Priority Data

Mar. 28, 2003 (JP) ..... 2003-091823
Mar. 28, 2003 (JP) ..... 2003-091871
Mar. 28, 2003 (JP) ..... 2003-091988
Mar. 28, 2003 (JP) ..... 2003-092015
Mar. 28, 2003 (JP) ..... 2003-092064

(51) Int. Cl.
*B41J 5/08* (2006.01)
*B41J 5/10* (2006.01)
*B41J 5/12* (2006.01)

(52) U.S. Cl. ..... 400/472; 400/680; 400/488; 400/489; 345/168; 234/146; 234/145 A

(58) Field of Classification Search ..... 400/472, 400/488, 489, 492, 680; 345/168; 235/146, 235/146 A; B41J 5/08
See application file for complete search history.

(56) References Cited

U.S. PATENT DOCUMENTS 5,574,481 A 11/1996 Lee
6,552,281 B2 * 4/2003 Katakami et al. ..... 200/5 A
6,698,957 B2 * 3/2004 Huang ..... 400/472
6,734,809 B1 * 5/2004 Olodort et al. ..... 341/22
6,920,039 B2 * 7/2005 Mochizuki et al. ..... 361/680
2004/0151527 A1 * 8/2004 Sitalasai et al. ..... 400/472
2004/0195305 A1 * 10/2004 Dotson ..... 235/145 R
2004/0203513 A1 * 10/2004 Kwon ..... 455/90.3

FOREIGN PATENT DOCUMENTS

JP A 2000-056904 2/2000

OTHER PUBLICATIONS

U.S. Appl. No. 10/717,486, filed Nov. 21, 2003, Mochizuki et al.

* cited by examiner

*Primary Examiner*—Daniel J. Colilla
*Assistant Examiner*—Marissa Ferguson
(74) *Attorney, Agent, or Firm*—Oliff & Berridge PLC

(57) ABSTRACT

In a foldable keyboard, a cover member (100) includes a cover part (101) provided with a cover plate (104) and a pair of supporting elements (102, 103) formed on both ends of the cover plat. The supporting elements are each formed with a first slot (117) and a second slot (118). A support screw (123) passes with play through the first slot and is fixedly received in a baring hole (13A) of a bearing member (13) formed in a corner (12B) of a first keyboard unit (3) and a support screw (124) passes with play through the first slot and is fixedly received in a support hole (121) of a first base plate (5) formed in a corner (12A). A support screw (125) passes with play through the second slot and is fixedly received in a bearing hole (17A) of a bearing member (17) formed in a corner (16B) of a second keyboard unit (4) and a support screw (126) passes with play through the second slot and is fixedly received in a support hole (120) of a second base plate (8) formed in a corner (16A).

21 Claims, 25 Drawing Sheets

(A)

(B)

(C)

FOLDABLE KEYBOARD

BACKGROUND OF THE INVENTION

1. Field of the Invention

The present invention relates to a foldable keyboard with superior portability and good operationality in use and, more particularly, to a foldable keyboard including two keyboard units and a cover member which is turned in synchronization with rotation of each keyboard unit and covers end faces and both side portions of each end face of the keyboard units held in a superposed state.

2. Description of Related Art

Heretofore, there have been proposed various types of foldable keyboards including two separate keyboard units rotatably connected with each other. When the keyboard is not in use, the keyboard units are superposed one on top of the other to bring the keyboard into a folded compact state, thus making it easy to carry anywhere. When in use, on the other hand, the keyboard units are separated to unfold the keyboard into a spread state, thus providing high operationality equivalent to standard keyboards.

However, the above keyboard has the following disadvantages. When the keyboard units rotatably connected with each other are superposed, their end faces (the backsides) are directly exposed. This causes the entry of dirt or the like in the inside of each key switch, leading to operational or mechanical troubles, and also the appearance of the keyboard is deteriorated.

To avoid the above disadvantages, for example, Japanese patent unexamined publication No. 2000-56904 (pages 3–5 and FIGS. 1–12) discloses a foldable keyboard including two separate keyboards at least one of which is slidably supported on a support plate. The separate keyboards are rotatably connected to both sides of a back plate, directly or via the support plate. In this keyboard, when the two keyboards are folded, the back plate covers end faces of the keyboards, like a spine of a book, to prevent dust and waterdrops from entering the keyboards.

Furthermore, U.S. Pat. No. 5,574,481 (second and third columns and FIGS. 2, 7, and 9) discloses a foldable keyboard including two separate keyboard units which are connected to be brought into or out of contact with each other, so that the keyboard units can be folded while they are set apart from each other. In this keyboard, after folding, a cover plate placed slidably to cover both side portions of each end face of the keyboard units. This cover plate is slid and turned to cover the end faces of the keyboard units.

In the former keyboard (JP-A-2000/56904), however, the back plate covers the end faces of the two separate keyboards, whereas it cannot cover over the both side portions of each end face of the keyboards when folded, as shown in FIG. 8 of JP-A-2000/56904.

Similarly, in the latter keyboard (U.S. Pat. No. 5,574,481), the cover plate covers the end faces of the two keyboard units, whereas it cannot cover over the both side portions of each end face of the keyboard units when folded, as shown FIG. 9 of U.S. Pat. No. 5,574,481.

Furthermore, in the former keyboard (JP-A-2000/56904), the two separate keyboards are rotatably connected to both sides of the back plate. Thus, two rotational connecting parts are provided at the sides of the back plate. With this structure, the folding and opening motions of the keyboards tend to be unstable.

In the latter keyboard (U.S. Pat. No. 5,574,481), the two keyboard units have to be mutually folded or horizontally opened while they are set apart from each other. Accordingly, the folding and opening motions of the keyboard units tend to be unstable.

Meanwhile, compact portable devices such as a personal digital assistant (PDA) have remarkably progressed and come into wide use. The compact portable devices of this type, provided with key switches, are of a small body which needs small-sized key switches and others. Thus, the development of a portable keyboard that can be connected with such portable devices has been demanded.

However, the former keyboard (JP-A-2000/56904) in which the two separate keyboards are rotatably connected with the both sides of the back plate so as to be foldable has been proposed without consideration of the connection of the keyboard with the compact portable devices such as a PDA.

The latter keyboard (U.S. Pat. No. 5,574,481) also has been proposed without consideration of the connection of the keyboard with the compact portable devices such as a PDA.

SUMMARY OF THE INVENTION

The present invention has been made in view of the above circumstances and has an object to overcome the above problems and to provide a foldable keyboard including two keyboard units and a cover member which is turned in synchronization with rotation of the keyboard units to cover end faces or both side portions of each end face of the keyboard units when superposed in order to prevent dust and waterdrops from entering the keyboard from the end faces and both side portions of each end face of the keyboard units.

The second object of the present invention is to provide a foldable keyboard in which two keyboard units are inhibited from rotating to be folded as long as the keyboard units are in a horizontal state, thereby making sure a stable operation of the keyboard in any places as well as on the desk.

The third object of the present invention is to provide a foldable keyboard in which two keyboard units are inhibited from horizontally turning while the keyboard units are not in a horizontal state, thereby securely preventing the keyboard units from protruding outside during carrying of the folded keyboard.

The fourth object of the present invention is to provide a foldable keyboard in which two keyboard units are rotatably connected by means of a rotation rod and two turnably jointed links, thereby allowing the keyboard units to stably, smoothly rotate with respect to each other about the rotation rod.

The fifth object of the present invention is to provide a foldable keyboard adapted to prevent the keyboard units from tilting to partially lift their bottoms from a setting plane due to the weight of a compact portable device such as a PDA placed on and connected with the keyboard.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the keyboard further includes: first support parts formed in opposite corners in one side of the first keyboard unit; second support parts formed in opposite corners in one side of the second keyboard unit; a cover member including a cover part, a pair of supporting elements formed on both ends of the cover part, first slots formed in the supporting elements respectively to correspond to each first support part, and second slots formed in the supporting elements to correspond to each second support part; first support shafts supported in the first support parts respectively, each first support shaft passing through each first slot with play; second support shafts supported in the second support parts respectively, each second support shaft passing through each second slot with play; when the first and second keyboard units are rotated from the horizontally arranged state to the superposed state, the cover member is synchronously turned by cooperation between the first support shafts and the first slots and between the second support shafts and the second slots, and the cover part of the cover member covers end faces of the first and second keyboard units in the superposed state and the support elements of the cover member cover side portions of each end face of the first and second keyboard units.

According to the above mentioned keyboard, which is constructed such that the first and second slots are formed in the pair of supporting elements provided on both ends of the cover part of the cover member, the first support shafts are supported in the first support parts formed in opposite corners in one side of the first keyboard unit, each first support shaft passing through each first slot with play (clearance), while the second support shafts are supported in the second support parts formed in opposite corners in one side of the second keyboard unit, each second support shaft passing through each second slot with play (clearance), so that the cover member is turned in synchronization with rotation of the first and second keyboard units by cooperation between the first support shafts and the first slots and between the second support shafts and the second slots, and the cover part of the cover member covers the end faces of both units held in the folded state and the supporting elements cover the side portions of the lengthwise ends of each end face, it is possible to prevent dust, waterdrops, etc. from entering the keyboard from the end faces and respective side portions of the ends in the lengthwise direction. An appearance of the keyboard can also be enhanced.

According to another aspect, the present invention provides a foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the first keyboard unit includes a first base plate and a first unit comprising a first support plate provided to be turnable in a horizontal direction on the first base plate and a plurality of key switches arranged on the first support plate; the second keyboard unit includes a second base plate and a second unit comprising a second support plate provided to be turnable in a horizontal direction on the second base plate and a plurality of key switches arranged on the second support plate; the keyboard further includes: first support parts formed in opposite corners in one side of the first keyboard unit; second support parts formed in opposite corners in one side of the second keyboard unit; a cover member including a pair of supporting elements which are turnably connected with the first and second support parts respectively so that the cover member covers end faces of the first and second keyboard units in the superposed state; and a pair of grooves which are formed on both sides of one of the support elements and in which circular arc faces of the first and second support plates are slidably engaged.

In the above foldable keyboard, the pair of supporting elements of the cover member are turnably connected with the first support parts formed in the first base plate and with the second support parts formed in the second base plate, so that the cover member is turned in synchronization with rotation of the first and second keyboard units about the rotation rod, the cover member covers the end faces of both units in the folded state, and the supporting elements of the cover member cover the side portions of the lengthwise ends of each end face, it is possible to prevent dust, waterdrops, etc. from entering the keyboard from the end faces and the side portions of the ends in the lengthwise direction. An appearance of the keyboard can also be enhanced.

Further, the pair of grooves are formed on both sides of one of the supporting elements, one of which slidably receives the circular arc face of the first support plate of the first unit horizontally turnably provided on the first base plate, while the other slidably receives the circular arc face of the second support plate of the second unit horizontally turnably provided on the second base plate. Accordingly, when the first and second keyboard units are horizontally turned, the circular arc faces are engaged in the associated grooves of the supporting element. This makes it possible to inhibit a folding operation of the first and second keyboard units due to an engagement relation between each circular arc face and the corresponding grooves. Thus, even when the first and second keyboard units are horizontally turned, a horizontal position of each keyboard unit can surely be maintained, which allows for a stable operation of the keyboard in any place as well as on a desk.

According to another aspect, furthermore, the present invention provides a foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the first keyboard unit includes a first base plate and a first unit comprising a first support plate provided to be turnable in a horizontal direction on the first base plate and a plurality of key switches arranged on the first support plate; the second keyboard unit includes a second base plate and a second unit comprising a second support plate provided to be turnable in a horizontal direction on the second base plate and a plurality of key switches arranged on the second support plate; the keyboard further includes: first support parts formed in opposite corners in one side of the first keyboard unit; second support parts formed in opposite corners in one side of the second keyboard unit; a cover member including a pair of supporting elements which are turnably connected to the first and second support parts respectively so that the cover member covers end faces of the first and second keyboard units in the superposed state; and the cover member inhibits turning of the first and second support plates in the superposed state and in course of rotation from the superposed state to the horizontally arranged state.

In the above foldable keyboard, the pair of supporting elements of the cover member are turnably connected with the first support parts formed in the first base plate and with the second support parts formed in the second base plate, so that the cover member is turned in synchronization with rotation of the first and second keyboard units about the rotation rod, the cover member covers the end faces of both units in the folded state, and the supporting elements of the cover member cover the side portions of the lengthwise ends of each end face, it is possible to prevent dust, waterdrops, etc. from entering the keyboard from the end faces and the side portions of the ends in the lengthwise direction. An appearance of the keyboard can also be enhanced.

Further, the cover member is constructed to inhibit the turning of the first and second support plates as long as the first and second keyboard units are held in the superposed state or they are rotated from the superposed state toward the horizontally arranged state. Accordingly, when the first and second keyboard units are not held in the horizontal state, they are inhibited from turning horizontally. Thus, the keyboard units can be prevented surely from protruding outside during carrying or transport of the folded keyboard.

According to another aspect, furthermore, the present invention provides a foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the keyboard further includes: first support parts formed in opposite corners in one side of the first keyboard unit; second support parts formed in opposite corners in one side of the second keyboard unit; a first link turnably supported in the first support part through the first support shaft; a second link turnably supported in the second support part through the second support shaft; and a joint rod which pivotally joints the first and second links to allow for turning of the links with respect to each other.

In the above foldable keyboard, the first and second keyboard units are rotatably connected through the rotation rod, the first link is turnably supported by the first support shaft and the second link is turnably supported by the second support shaft so that the first link and second links are pivotally jointed by the joint rod. Accordingly, the first and second keyboard units can be rotated mutually stably by a linkage action of the first and second links.

According to another aspect, the present invention provides a foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the keyboard further includes: first support parts formed in opposite corners in one side of the first keyboard unit; second support parts formed in opposite corners in one side of the second keyboard unit; a cover member including a pair of supporting elements which are turnably connected to the first and second support parts respectively and a cover part formed between the supporting elements, the cover member being adapted to cover end faces of the first and second keyboard units in the superposed state; a device support member which is raised to a standing orientation in conjunction with the rotation of the first and second keyboard units in a direction that they come apart; and a keyboard stabilizing member provided in the cover part of the cover member so that the stabilizing member is pulled in an axial direction of the rotation rod to outside of the first and second keyboard units; the keyboard stabilizing member is in a pulled state outside the first and second keyboard units while the device support member supports a device to prevent the first and second keyboard units from so tilting as to partially lift their bottoms from a setting plane.

In the above foldable keyboard, the cover part of the cover member is provided with the keyboard stabilizing member provided to be pulled outside the first and second keyboard units in the axial direction of the rotation rod. The keyboard stabilizing member is pulled outside the first and second keyboard units to support a device in the device support members, thereby preventing both units from tilting to lift their bottom from a setting place. Thus, even when a compact portable device such as a PDA set on the device support members, the keyboard can be operated stably.

In addition, the cover member is turned in synchronization with rotation of the first and second keyboard units, the cover part of the cover member covers the end faces of both units in the superposed state and the supporting elements of the cover part cover the side portions of lengthwise ends of each end face. It is therefore possible to prevent dust, waterdrops, etc. from entering the keyboard from the end faces of both units and the side portions of the lengthwise ends of each end face. An appearance of the keyboard can also be enhanced.

Furthermore, according to another aspect, the present invention provides a foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the first keyboard unit includes a first base plate with a first frame portion and a first unit comprising a first support plate with a first wall member provided to be turnable in a horizontal direction on the first base plate and a plurality of key switches arranged on the first support plate; the second keyboard unit includes a second base plate with a second frame portion and a second unit comprising a second support plate with a second wall member provided to be turnable in a horizontal direction on the second base plate and a plurality of key switches arranged on the second support plate; the keyboard further includes: first support parts formed in opposite corners in one side of the first keyboard unit; second support parts formed in opposite corners in one side of the second keyboard unit; a cover member including a pair of support elements which are turnably connected to the first and second support parts respectively so that the cover member covers end faces of the first and second keyboard units in the superposed state; and a pair of first and second pawl members formed in one of the support elements of the cover member, each pawl member having pawl on a top end thereof; wherein the pawl of the first pawl member contacts with a wall plane of the first wall member and the pawl of the second pawl member contacts with a wall plane of the second wall member when the first and the second keyboard unit are horizontally arranged with each other, and wherein the pawl of the first pawl member engages with a shoulder formed between the first frame portion and the first wall member and the pawl of the second pawl member engages with a shoulder formed between the second frame portion and the second wall member, when the first support plate is turned in the horizontal direction on the first base plate and the second support plate is turned in the horizontal direction on the second base plate, thereby the first and second keyboard units are inhibited from folding thereof.

According to another aspect, the present invention provides a foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the first keyboard unit includes a first base plate with a first frame portion and a first unit comprising a first support plate with a first wall member provided to be turnable in a horizontal direction on the first base plate and a plurality of key switches arranged on the first support plate; the second keyboard unit includes a second base plate with a second frame portion and a second unit comprising a second support plate with a second wall member provided to be turnable in a horizontal direction on the second base plate and a plurality of key switches arranged on the second support plate; the keyboard further includes: a first locking groove formed in the first wall member; a first slide groove formed in the first wall member, the first slide groove being connected to the first locking groove and extended toward the rotation rod; a second locking groove formed in the second wall member; a second slide groove formed in the second wall member, the second slide groove being connected to the second locking groove and extended toward the rotation rod; a first locking member having a projection and a shaft connected to the projection, the projection being slidably arranged within the first locking groove and the shaft being slidably arranged in the first slide groove; a second locking member having a projection and a shaft connected to the projection, the projection being slidably arranged within the second locking groove and the shaft being slidably arranged in the second slide groove; a first spring arranged in the first locking groove, the first spring pressing the shaft of the first locking member toward the rotation rod; a second spring arranged in the second locking groove, the second spring pressing the shaft of the second locking member toward the rotation rod; wherein both end planes of the shafts of the first locking member and the second locking member contact with each other when the first and the second keyboard units are horizontally arranged, thereby the first and second keyboard units are made turnable in the horizontal direction, and wherein the projection of the first locking member is locked in the first locking groove and the projection of the second locking member is locked in the second locking groove when the first and second keyboard units are in a state other than a state that the first and second keyboard units are horizontally arranged, thereby the first and second keyboard units are inhibited from turning in the horizontal direction.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of a foldable keyboard embodying the present invention will now be given referring to the accompanying drawings.

Figure 1:
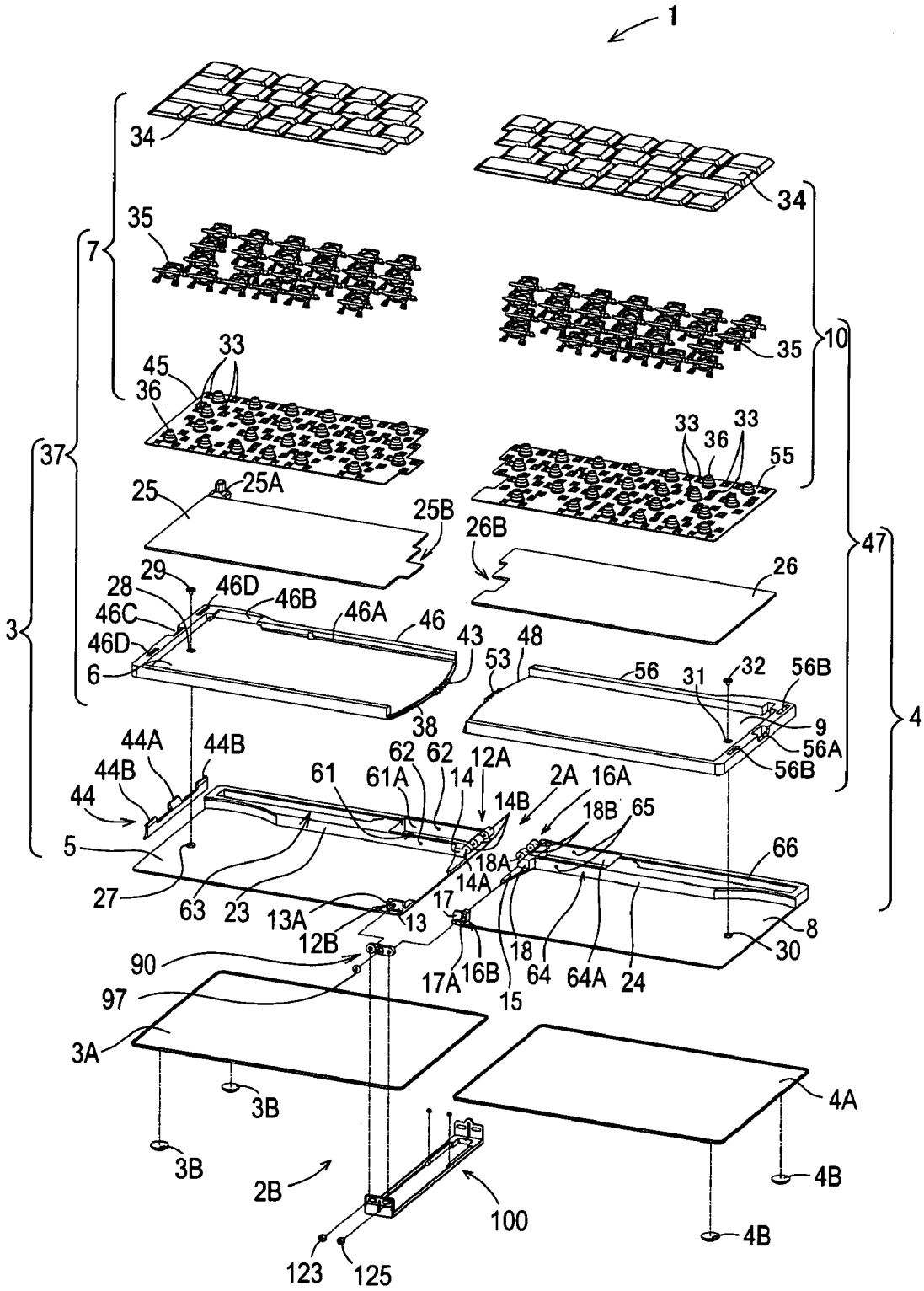
FIG. 1 is an exploded perspective view of a foldable keyboard in an embodiment, seen from the front.

First, the structure of the keyboard in the present embodiment is explained with reference to FIGS. 1 and 2. FIG. 1 is an exploded perspective view of the keyboard, seen from the front; and FIG. 2 is an exploded perspective view of the keyboard, seen from the back.

Figure 2:
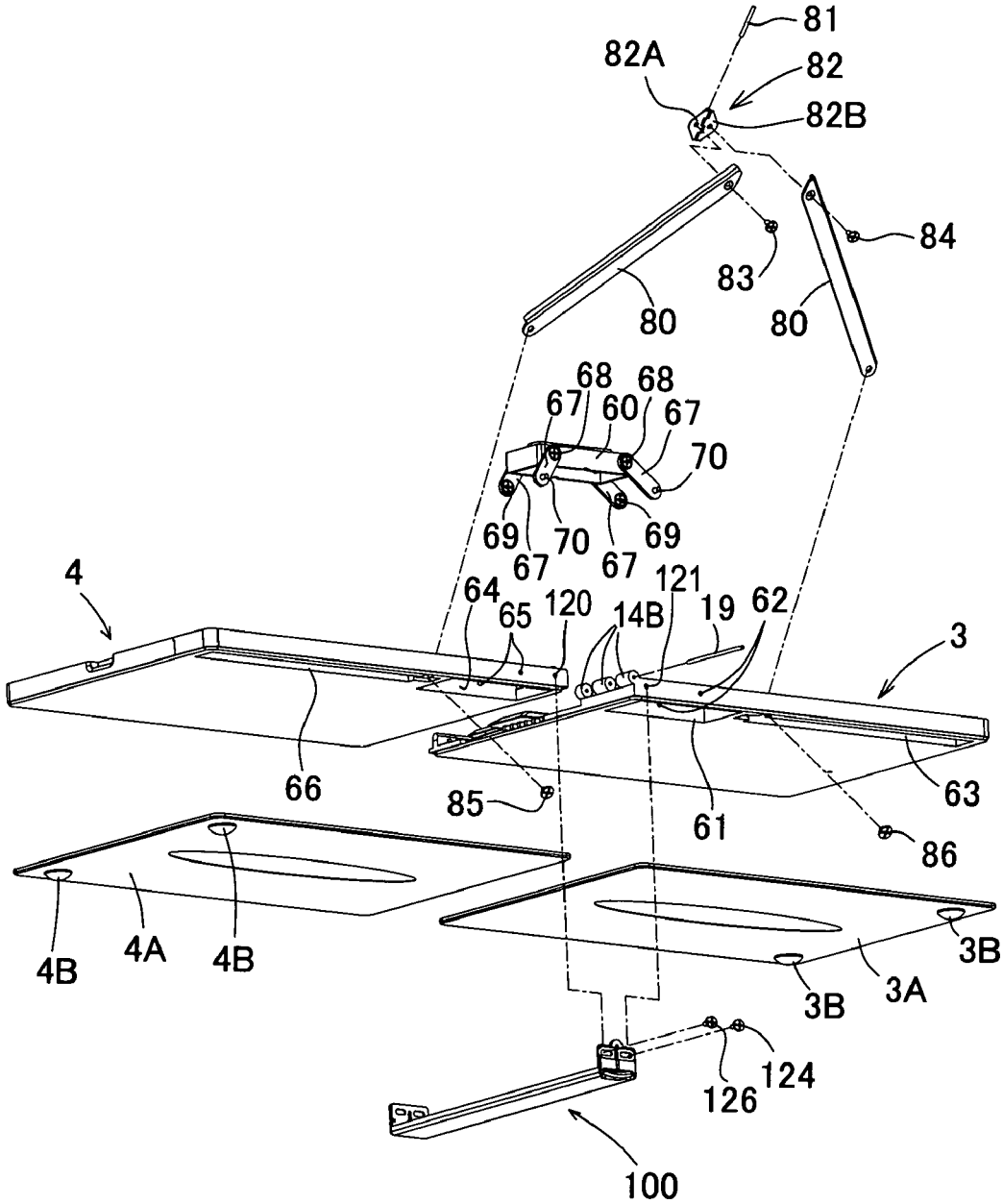
FIG. 2 is an exploded perspective view of the foldable keyboard, seen from the back.

In FIGS. 1 and 2, a keyboard 1 is mainly constructed of a first keyboard unit 3 and a second keyboard unit 4 which are rotatably connected with each other through a first rotational connecting part 2A (at the back side in FIGS. 1 and 2) and a second rotational connecting part 2B (at the front side in FIGS. 1 and 2). The first keyboard unit 3 includes a first surface plate 3A attached with two rubber support legs 3B in two outer corners, a first base plate 5, a first support plate 6 mounted to be horizontally turnable on the first base plate 5, and a plurality of key switches 7 arranged on the first support plate 6. The second keyboard unit 4 includes a second surface plate 4A attached with two rubber support legs 4B in two outer corners, a second base plate 8, a second support plate 9 mounted to be horizontally turnable on the second base plate 8, and a plurality of key switches 10 arranged on the second support plate 9.

The first rotational connecting part 2A is first explained below. The first base plate 5 is made of a metallic, e.g., aluminum, thin plate and is provided, in a side end (a right end in FIG. 1), in a corner 12A positioned at the back in FIG. 1, with a resinous bearing member 14 constituting a part of the first rotational connecting part 2A. The bearing member 14 is formed of three bearings 14B which are spaced apart and each have a bearing hole 14A. The second base plate 8 is, like the first base plate 5, made of a metallic, e.g., aluminum, thin plate and is provided, in a side end (a left end in FIG. 1), in a corner 16A positioned at the back in FIG. 1, with a resinous bearing member 18 constituting a part of the first rotational connecting part 2A. The bearing member 18 is formed of two bearings 18B which are spaced apart and each have a bearing hole 18A.

Each bearing 18B is fit between adjacent two of the bearings 14B. At this time, the bearing holes 18A of the bearings 18B and the bearing holes 14A of the bearings 14B are aligned with one another and therein a rotation rod 19 is inserted (see FIG. 2). This rod 19 supports the first base plate 5 and the second base plate 8 to be rotatable with respect to each other.

The bearing member 14 in the first base plate 5 is integrally formed with a hollow frame portion 23 through which a signal line (not shown) runs to connect each key switch 7 in the first keyboard unit 3 to a connector unit 60 mentioned later. In the frame portion 23, a connector storage recess 61 for storing the connector unit 60 is formed adjacent to the bearing member 14. The connector storage recess 61 is formed with screw holes 62 in opposite spaced inner walls 61A (only one of which is shown in FIG. 1). The screw holes 62 will be mentioned later together with a support system for the connector unit 60.

The connector storage recess 61 is used, in cooperation with another connector storage recess (mentioned later) formed in the second base plate 8 in the second keyboard unit 4, to store the connector unit 60 in the keyboard 1 when the first and second keyboard units 3 and 4 are folded.

Alongside of the connector storage recess 61, the frame portion 23 is provided with a storage concave portion 63 to store therein a pair of support members 80 in a folded state. Specifically, this storage concave portion 63 is used, in cooperation with a storage concave portion (mentioned later) formed in the second base plate 8, to store the pair of support members 80 when the support members 80 are folded in synchronization with the folding of the first and second keyboard units 3 and 4.

The bearing member 18 in the second base plate 8 is integrally formed with a hollow frame portion 24 which a signal line (not shown) runs through to connect each key switch 10 arranged in the second keyboard unit 4 to the connector unit 60. In the frame portion 24, a connector storage recess 64 for storing the connector unit 60 is formed adjacent to the bearing member 18. The connector storage recess 64 is formed with screw holes 65 in opposite spaced inner walls 64A (only one of which is shown in FIG. 1). The screw holes 65 will be mentioned later together with the support system for the connector unit 60.

The connector storage recess 64 is used, in cooperation with the connector storage recess 61 formed in the first base plate 5 in the first keyboard unit 3, to store the connector unit 60 in the keyboard 1 when the first and second keyboard units 3 and 4 are folded.

Furthermore, alongside of the connector storage recess 64, the frame portion 24 is provided with a storage concave portion 66 to store therein the pair of support members 80. Specifically, this storage concave portion 66 is used in cooperation with the storage concave portion 63 formed in the first base plate 5 to store the pair of support members 80, when the support members 80 are folded in synchronization with the folding of the first and second keyboard units 3 and 4.

Next, the second rotational connecting part 2B is explained below. The first base plate 5 is provided, in a corner 12B positioned at the front in FIG. 1, opposite to the corner 12A, with a resinous bearing member 13 constituting a part of the second rotational connecting part 2B. The bearing member 13 is formed with a bearing hole 13A. The second base plate 8 is provided, in a corner 16B positioned at the front in FIG. 1, opposite to the corner 16A, with a resinous bearing member 17 constituting a part of the second rotational connecting part 2B. The bearing member 17 is formed with a bearing hole 17A.

The above bearing members 13 and 17 are connected with a cover member 100 by means of a linkage system 90 interposed therebetween.

Figure 3:
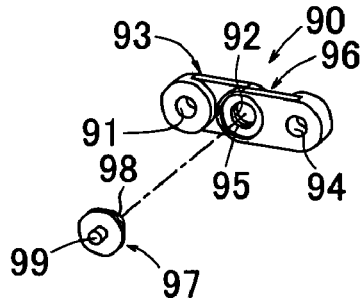
FIG. 3 is an enlarged view of a linkage system.

This linkage system 90 is explained below with reference to FIG. 3. FIG. 3 is an enlarged view of the linkage system 90. This system 90 is constructed of a link 93 formed with a support hole 91 at one end (a left end in FIG. 3) and a joint hole 92 at the other end (a right end in FIG. 3) and a link 96 formed with a support hole 94 at one end (a right end in FIG. 3) and a joint hole 95 (a left end in FIG. 3). A joint rod 98 of a joint element 97 is inserted in the aligned joint holes 92 and 95 of the links 93 and 96 disposed in partially overlapping relation. Thus, the links 93 and 96 are jointed to mutually turn about the joint rod 98 of the joint element 97. It is to be noted that the joint element 97 is also formed with a projection 99 on an opposite side to the joint rod 98. The effect of this projection 99 will be mentioned later.

Figure 4:
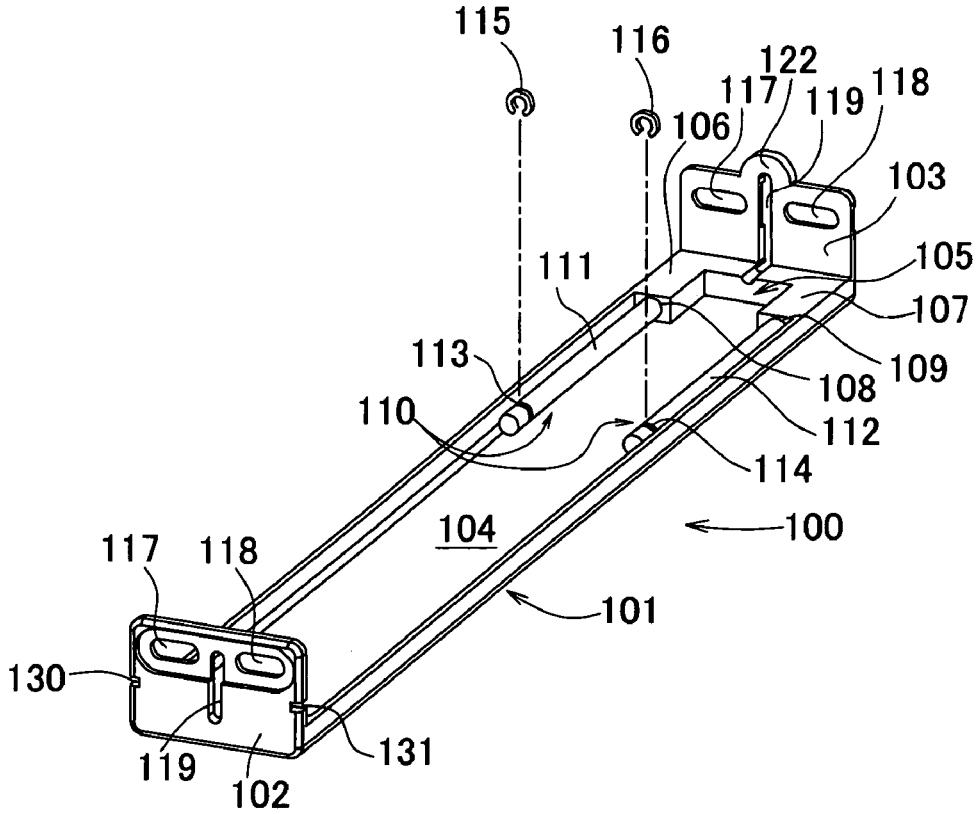
FIG. 4 is an enlarged view of a cover member.

The cover member 100 is explained below with reference to FIG. 4. FIG. 4 is an enlarged perspective view of the cover member 100. This cover member 100 is mainly constructed of a cover part 101 and a pair of supporting end plates 102 and 103 provided upright and integrally with the both ends of the cover part 101 in the longitudinal direction. The cover part 101 includes a cover plate 104 which is of a substantial rectangular shape. The width of the cover plate 104 is determined to be slightly wider than the total thickness of the first and second keyboard units 3 and 4 in order to fully cover the end faces of both units 3 and 4 when folded. The cover plate 104 is formed, at an end (a longitudinal back end in FIG. 4), with thick base parts 106 and 107 disposed on both sides of a concave portion 105. The base parts 106 and 107 are formed respectively with sliding holes 108 and 109 perforated in the longitudinal direction of the cover plate 104. A stabilizing member 110 shaped like a Japanese syllabary character "コ" in plan view, like a U-shape, is set on the cover plate 104 so that rods 111 and 112 of the stabilizing member 110 are slidably mounted in the sliding holes 108 and 109. The rods 111 and 112 are formed with stopper grooves 113 and 114 adjacent to respective end portions. In these stopper grooves 113 and 114, stopper rings 115 and 116 each having a U-shape are fit respectively. The stabilizing member 110 constructed as above can be pulled in the longitudinal direction of the cover plate 104 (corresponding to the axial direction of the rotation rod 19) to the outside of the first and second keyboard units 3 and 4. In use, the stabilizing member 110 is pulled outside from a storage position shown in FIG. 4 until the stopper rings 115 and 116 come into contact with side faces of the base parts 106 and 107 in which the sliding holes 108 and 109 are opened. In nonuse, on the other hand, the stabilizing member 110 is pushed into the storage position as shown in FIG. 4. This stabilizing member 110 is used to securely support the keyboard 1 in the following situation. During use of the first and second keyboard units 3 and 4 arranged in a horizontal state, the support members 80 are set up in a standing orientation to hold a compact portable device such as a personal digital assistance (PDA). At this time, there may be a case where the support members 80 cannot stably hold by itself the compact portable device depending on the weight thereof. In this case, the first and second keyboard units 3 and 4 are caused to tilt toward the back, thus partially lifting the bottoms of the keyboard units 3 and 4 from the setting place. To avoid such unstable state, the stabilizing member 110 is pulled outside (see FIGS. 21 and 22) to stably support the keyboard 1.

In the cover part 101, the supporting end plate 102 provided upright at one end (a front end in FIG. 4) of the cover plate 104 is formed with a first slot 117 and a second slot 118 which are horizontally aligned. The first slot 117 is positioned corresponding to the bearing hole 13A of the bearing member 13 formed in the first base plate 5 in the first keyboard unit 3. The second slot 118 is positioned corresponding to the bearing hole 17A of the bearing member 17 formed in the second base plate 8 in the second keyboard unit 4. Further, a third slot 119 is formed in the supporting end plate 102 to extend perpendicular to the longitudinal direction of the slots 117 and 118. In this third slot 119, the projection 99 of the joint element 97 is slidably inserted. The supporting end plate 102 is further formed with a groove (notch) 130 in the left side at an almost center in the height direction of the supporting end plate 102 and a groove (notch) 131 in the right side, opposite to the groove 130. In the groove 130, a thin plate part 38A (see FIG. 9) formed in a circular arc face 38 mentioned later of the first support plate 6 in the first keyboard unit 3 will slidably be engaged. In the groove 131, a thin plate part 48A (see FIG. 9) formed in a circular arc face 48 mentioned later of the second support plate 9 in the second keyboard unit 4 will slidably be engaged. The effects of the grooves 130 and 131 will be mentioned later.

In the cover part 101, the supporting end plate 103 provided upright at the other end (a back end in FIG. 4) of the cover plate 104 is formed with a first slot 117 which is of the same shape as and positioned opposite to the first slot 117 in the supporting end plate 102 and a second slot 118 which is of the same shape as and positioned opposite to the second slot 118 in the supporting end plate 102. The first slot 117 in the supporting end plate 103 is positioned corresponding to the support hole 121 (see FIG. 2) formed in the first base plate 5 in the first keyboard unit 3. The second slot 118 is positioned corresponding to the support hole 120 formed in the second base plate 8 in the second keyboard unit 4. In addition, the supporting end plate 103, like the supporting end plate 102, is formed with a third slot 119 extending perpendicular to the longitudinal direction of the slots 117 and 118. In this third slot 119 is inserted the end of the rotation rod 19 passing through the bearing holes 14A and 18A of the bearings 14B and 18B respectively. It is to be noted that a semicircular protruding portion 122 is formed in the supporting end plate 103 at its upper side. This semicircular protruding portion 122 is designed to be semicircular partially corresponding to the circular contour of each bearing 14B and 18B protruding upward from each upper surface of the frame portion 23 of the first base plate 5 and the frame portion 24 of the second base plate 8. Thus, the semicircular protruding portion 122 covers the end face of the bearing 14B (18B) from the back side of the keyboard 1, making the bearing 14B (18B) invisible from the outside the keyboard 1.

Next, explanation is made on the mechanism to support the connection of the above linkage system 90 and the cover member 100 with the first and second keyboard units 3 and 4.

As shown in FIG. 1, a support screw 123 passes, with play (clearance), through the first slot 117 in the supporting end plate 102 of the cover member 100 and passes through the support hole 91 in the link 93 of the linkage system 90. This support screw 123 is then fixedly received in the bearing hole 13A of the bearing member 13 formed in the first base plate 5 in the first keyboard unit 3, so that the screw 123 acts as a turning axis. As shown in FIG. 2, on the back side of the keyboard 1, a support screw 124 passes, with play (clearance), through the first slot 117 in the supporting end plate 103 and is fixedly received in the support hole 121 in the first base plate 5 so as to act as a turning axis. With this structure, the cover member 100 is connected with the first keyboard unit 3 on the front side through the linkage system 90 and also connected with the first keyboard unit 3 on the back side. In this state, the cover member 100 is allowed to turn about and move with respect to the support screw 123 through the first slot 117. The link 93 of the linkage system 90 is turnable about the support screw 123. As mentioned above, the links 93 and 96 are allowed to mutually turn through the joint rod 98, and the projection 99 of the joint element 97 is inserted with play in the third slot 119 in the supporting end plate 102.

As shown in FIG. 1, a support screw 125 passes, with play (clearance), through the second slot 118 in the supporting end plate 102 of the cover member 100 and passes through the support hole 94 in the link 96 of the linkage system 90. This support screw 125 is fixedly received in the bearing hole 17A of the bearing member 17 formed in the first base plate 8 in the second keyboard unit 4, so that the screw 125 acts as a turning axis. As shown in FIG. 2, on the back side of the keyboard 1, a support screw 126 passes, with play (clearance), through the second slot 118 in the supporting end plate 103 and is fixedly received in the support hole 120 in the second base plate 8 to act as a turning axis. With this structure, the cover member 100 is connected with the second keyboard unit 4 on the front side through the linkage system 90 and also connected with the second keyboard unit 4 on the back side. In this state, the cover member 100 is allowed to turn about and move with respect to the support screw 125 through the second slot 118. The link 96 of the linkage system 90 is allowed to turn about the support screw 125.

Returning to the FIG. 1, the structure of the first keyboard unit 3 is explained again. In the first base plate 5, a screw seat 27 is formed near the left side in FIG. 1, at an almost center. In this screw seat 27 is received a screw 29 having passed with play through a screw hole 28 in the first support plate 6. Thus, the first support plate 6 is mounted on the first base plate 5 to be horizontally turnable about the screw 29 and the screw seat 27 serving as a turning axis. In the second base plate 8, similarly, a screw seat 30 is formed near the right side in FIG. 1, at an almost center. In this screw seat 30 is received a screw 32 having passed with play through a screw hole 31 in the second support plate 9. Accordingly, the second support plate 9 is mounted on the second base plate 8 to be horizontally turnable about the screw 32 and the screw seat 30 serving as a turning axis.

The first support plate 6 of the first keyboard unit 3 is made of a metallic, e.g., aluminum, thin plate and provided circumferentially, except for the right side, with a peripheral wall member 46 shaped like a reverse Japanese syllabary character "コ" in plan view, like a horizontally oriented U-shape. Sliding grooves 46A are provided in the lower insides of the peripheral wall member 46 positioned on opposite sides of the first support plate 6 in the longitudinal direction. The sliding grooves 46A are used to guide a key support plate 25 mentioned later which slides on the first support plate 6. The peripheral wall member 46 is further formed with a sliding recess 46B near the left side of the first support plate 6 in FIG. 1. This sliding recess 46B restricts the moving range of a sliding knob 25A disposed on the key support plate 25. The peripheral wall member 46 in the first support plate 6 at the left side is centrally formed with a cutout 46C and through holes 46D on both sides of the cutout 46C. A pressing part 44A centrally formed in an engagement member 44 is placed in the cutout 46C and engaging pawls 44B formed on both sides of the pressing part 44A are inserted through the through holes 46D.

It is to be noted that the pressing part 44A will be caught in a catching part 56A formed in a peripheral wall member 56 of the second support plate 9 mentioned later, and the engaging pawls 44B will be fitted in positioning holes 56B formed in the peripheral wall member 56. When folded, or superposed, accordingly, the first and second keyboard units 3 and 4 can be securely held in that folded state.

In FIG. 1, the first support plate 6 is formed on the right side with the circular arc face 38 coincident with a turning-radius of the plate 6 about the turning axis (i.e., the screw 29 passing through the screw hole 28 with play and the screw seat 27). A first gear teeth part 43 is almost centrally formed in the circular arc face 38 and engages with a second gear teeth part 53 formed in the circular arc face 48 of the second support plate 9 mentioned later. Turning one of the first support plate 6 and the second support plate 9 causes the other to turn at the same time into a desired positional (or angle) relation by engagement between the first and second gear teeth parts 43 and 53. Accordingly, the first and second keyboard units 3 and 4 can be adjusted at a desired angle at which the keyboard 1 is most convenient for each individual user to operate. Thus, it is also seen from the ergonomic standpoint that this keyboard 1 is excellent.

The key support plate 25 supporting the plurality of key switches 7 is mounted on the first support plate 6 constructed as above. This key support plate 25 is provided with the sliding knob 25A near the left side in FIG. 1. The sliding knob 25A is placed in the sliding recess 46B in the peripheral wall member 46. This knob 25A is slidable in the length of the sliding recess 46B. Sliding the sliding knob 25A in the sliding recess 46B causes the key support plate 25 to slide along the sliding grooves 46A in the peripheral wall member 46. The key support plate 25 is further provided with a stair-like portion 25B in the right periphery. This stair-like portion 25B is of a contour mateable with the stair-like portion 26B of the key support plate 26.

A switch support plate 45 is mounted on the key support plate 25. This switch support plate 45 is integrally formed with four supporting parts 33 per one key switch 7 by press working or other techniques. On the switch support plate 45, there is placed a membrane switch sheet of a three-layer structure (including an upper sheet having a movable electrode, a lower sheet having a fixed electrode, and a spacer sheet placed between the upper and lower sheets and formed with a switching hole to separate the movable electrode and the fixed electrode). Each supporting part 33 is formed protruding upward through holes formed in the membrane switch. The switch support plate 45 is designed to have a right periphery identical in contour to the stair-like portion 25B of the key support plate 25.

The key switches 7, which are operated by the user's left hand, are arranged in a predetermined number on the key support plate 25. It is to be noted that the number of key switches 7 is determined based on the ISO International Standards (ISO 2126 and ISO 2530).

Each key switch 7 is mainly constructed of a key top 34, a pair of link members 35 for vertically guiding the key top 34, and a rubber spring 36 which is disposed on the membrane switch at a position corresponding to a switching part defined by the movable electrode and the fixed electrode of the membrane switch and urges the key top 34 upward. Each upper end of the link members 35 is movably connected with the key top 34 at its lower surface and each lower end of the link members 35 is movably engaged in each supporting part 33. During non-depression, the key top 34 is urged upward by the urging force of the rubber spring 36 and held in a non-depression position. When the key top 34 is pressed down against the urging force of the rubber spring 36, the rubber spring 36 pushes the movable electrode of the membrane switch to bring the movable electrode into contact with the fixed electrode in the switching hole, thereby performing a switching operation. The above mentioned key switches 7, the key support plate 25, and the first support plate 6 constitute a first key unit 37. The structure of each key switch 7 is well known in the art and the detailed explanation thereof is omitted herein.

The structure of each key switch 10 arranged on the second keyboard unit 4 is explained below. The second support plate 9 of the second keyboard unit 4 is made of a metallic, e.g., aluminum, thin plate and provided circumferentially, except for the left side, with a peripheral wall member 56 shaped like a Japanese syllabary character "コ" in plan view, like a horizontally oriented U-shape. The peripheral wall member 56 in the second support plate 9 at the right side is centrally formed with a catching part 56A and positioning holes 56B on both sides of the catching part 56A. The catching part 56A engages with the pressing part 44A as mentioned above. The positioning holes 56B fittingly receive the engaging pawls 44B individually. Thus, the first and second keyboard units 3 and 4 can be held securely in a folded relation.

In FIG. 1, the second support plate 9 is formed on the left side with the circular arc face 48 coincident with a turning-radius of the second support plate 9 about the turning axis (i.e., the screw 32 passing through the screw hole 31 with play and the screw seat 30). The second gear teeth part 53 is almost centrally formed in the circular arc face 48. As mentioned above, the second gear teeth part 53 engages with the first gear teeth part 43 formed in the circular arc face 38 of the first support plate 6. Accordingly, the first and second keyboard units 3 and 4 can be adjusted synchronously at a desired angle at which the keyboard 1 is most convenient to operate.

The key support plate 26 supporting the plurality of key switches 10 is mounted on the second support plate 9 constructed as above. This key support plate 26 is provided with the stair-like portion 26B which is of a contour mateable with the stair-like portion 25B of the key support plate 25 in the first keyboard unit 3.

A switch support plate 55 is mounted on the key support plate 26. This switch support plate 55 is integrally formed with four supporting parts 33 per one key switch 10 by press working or other techniques. On the switch support plate 55, there is placed a membrane switch sheet of a three-layer structure (including an upper sheet having a movable electrode, a lower sheet having a fixed electrode, and a spacer sheet placed between the upper and lower sheets and formed with a switching hole to separate the movable electrode and the fixed electrode). Each supporting part 33 is formed protruding upward through holes formed in the membrane switch. The switch support plate 55 is designed to have a left periphery identical in contour to the stair-like portion 26B of the key support plate 26.

The key switches 10, which are operated by the user's right hand, are arranged in a predetermined number on the key support plate 26. It is to be noted that the number of key switches 10 is determined based on the ISO International Standards (ISO 2126 and ISO 2530).

Each key switch 10 is mainly constructed of a key top 34, a pair of link members 35 for vertically guiding the key top 34, and a rubber spring 36 which is disposed on the membrane switch at a position corresponding to a switching part defined by the movable electrode and the fixed electrode of the membrane switch and urges the key top 34 upward. Each upper end of the link members 35 is movably connected with the key top 34 at its lower surface and each lower end of the link members 35 is movably engaged in each supporting part 33. During non-depression, the key top 34 is urged upward by the urging force of the rubber spring 36 and held in a non-depression position. When the key top 34 is pressed down against the urging force of the rubber spring 36, the rubber spring 36 pushes the movable electrode of the membrane switch to bring the movable electrode into contact with the fixed electrode in the switching hole, thereby performing a switching operation. The above mentioned key switches 10, the key support plate 26, and the second support plate 9 constitute a second key unit 47. The structure of each key switch 10 is well known in the art and the detailed explanation thereof is omitted herein.

The supporting structures of the connector unit 60 and the support members 80 are explained below. First, the connector unit 60 is mentioned. As shown in FIG. 2, two pairs of links 67 and 67 are pivotally attached to the opposite long side surfaces of the connector unit 60, one pair to one side surface, by means of screws 68. A screw 69 is attached to a lower end of each link 67 to pass therethrough, when a rod 70 of the screw 69 extends outside. The rods 70 of the screws 69 are pivotally mounted in screw holes 62 in the connector storage recess 61 and screw holes 65 in the connector storage recess 64, respectively.

With the above structure, when the first and second keyboard units 3 and 4 are folded, the connector unit 60 is stored in the keyboard 1 in which the connector storage recesses 61 and 64 are combined. As the first and second keyboard units 3 and 4 are rotated toward an open position, the connector unit 60 is gradually moved up. At the time when the first and second keyboard units 3 and 4 are fully opened into a horizontally arranged state, the center axis (perpendicular to the long sides) of the connector unit 60 is positioned above the first rotational connecting part 2A.

Second, the supporting structure of each support member 80 is explained. As shown in FIG. 2, an upper end of one of the support members 80, namely, a left one in FIG. 2, is pivotally attached to a left part 82A of a joint plate 82 by a locking pin 83. An upper end of the other support member 80, namely, a right one in FIG. 2, is a pivotally attached to a right part 82B of the joint plate 82 by a locking pin 84. The joint plate 82 is so designed to allow the left part 82A and the right part 82B to be turned mutually about a rod 81 connecting the parts 82A and 82B. A lower end of the left support member 80 is pivotally attached to the inner wall of the storage concave portion 66 in the second keyboard unit 4 by a screw 85. A lower end of the right support member 80 is pivotally attached to the inner wall of the storage concave portion 63 in the first keyboard unit 3 by a screw 86.

Figure 5:
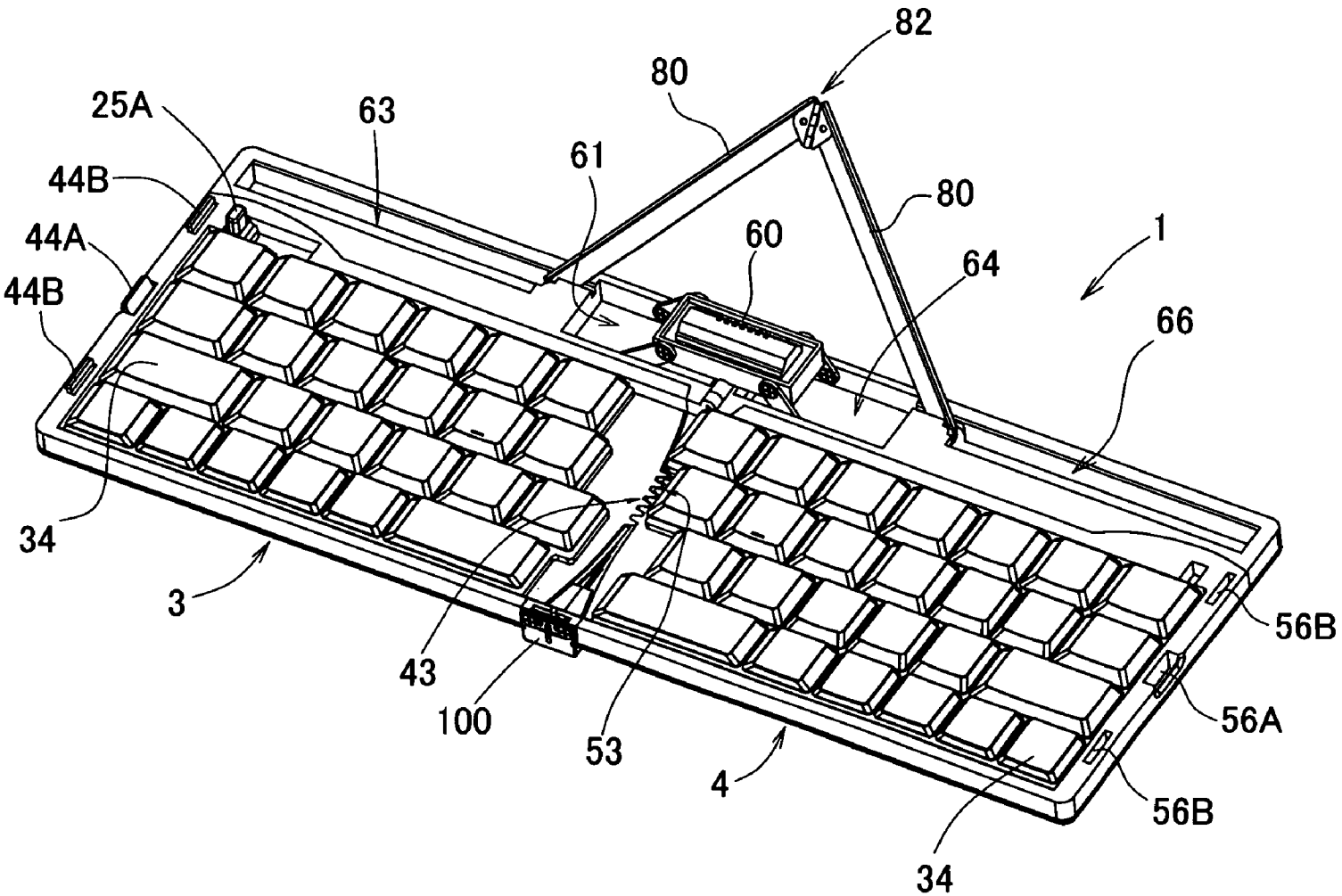
FIG. 5 is a perspective view of the keyboard in use, in which a first and second keyboard units are set in a horizontally arranged state.

The support members 80 and 80 are stored in a folded state in the keyboard 1 in which the storage concave portions 63 and 66 are combined when the first and second keyboard units 3 and 4 are folded. As the first and second keyboard units 3 and 4 are rotated toward an open position, the support members 80 and 80 are gradually raised while their lower ends are moved away from each other. At the time when the first and second keyboard units 3 and 4 are fully opened into a horizontally arranged position, the support members 80 and 80 come to an upstanding position with the joint plate 82 centrally placed above the connector unit 60 as shown in FIG. 5. In this state, the support members 80 and 80 can support a compact portable device such as a PDA.

It is to be noted that the supporting structures of the connector unit 60 and the support members 80 and 80 are identical to those disclosed in the specification and drawings of Japanese patent application No. 2002-350329 which was filed by the applicant of this invention. Refer to the specification and drawings of JP-A-2002/350329 for more information about the supporting structures of the connector unit 60 and the support members 80 and 80. The details thereof are omitted herein.

Next explanation is made on the operations of the linkage system 90 and the cover member 100 of the above constructed keyboard 1 during rotation of the first and second keyboard units 3 and 4.

As shown in FIG. 5, the first and second keyboard units 3 and 4 are first fully opened into a horizontally arranged position which is a normal usable state. A user may operate the keyboard 1 in this state.

Figure 6:
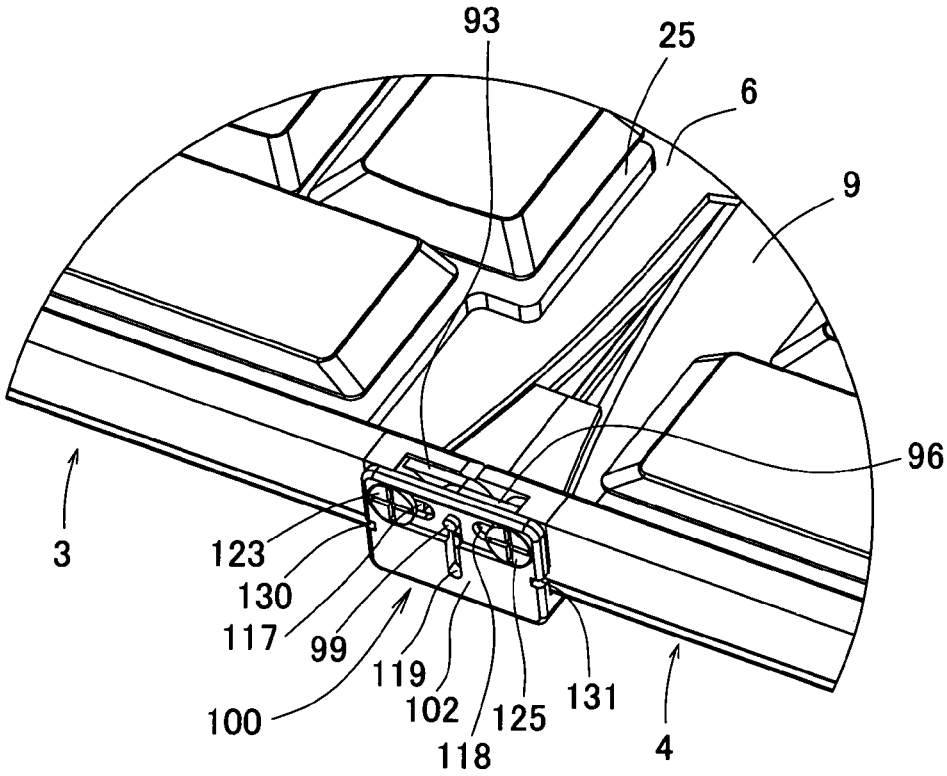
FIG. 6 is an enlarged partial view showing the cover in FIG. 5.
Figure 7:
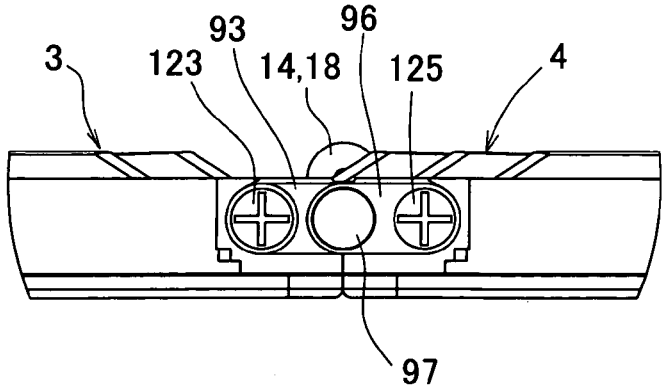
FIG. 7 is an enlarged front view of the linkage system in FIG. 6, from which the cover is removed for convenience of explanation.

FIG. 6 is an enlarged view of a part of the cover member 100 in this state. FIG. 7 is an enlarged front view of the linkage system 90, from which the cover member 100 is removed for convenience of explanation. In the cover member 100 shown in FIG. 6, the support screw 123 is located in a leftmost position in the first slot 117 and the support screw 125 is located in a rightmost position in the second slot 118. The projection 99 of the joint element 97 pivotally jointing the links 93 and 96 of the linkage system 90 is located in an uppermost position in the third slot 119. As shown in FIG. 7, the links 93 and 96 of the linkage system 90 are arranged in horizontal alignment with each other.

Figure 8:
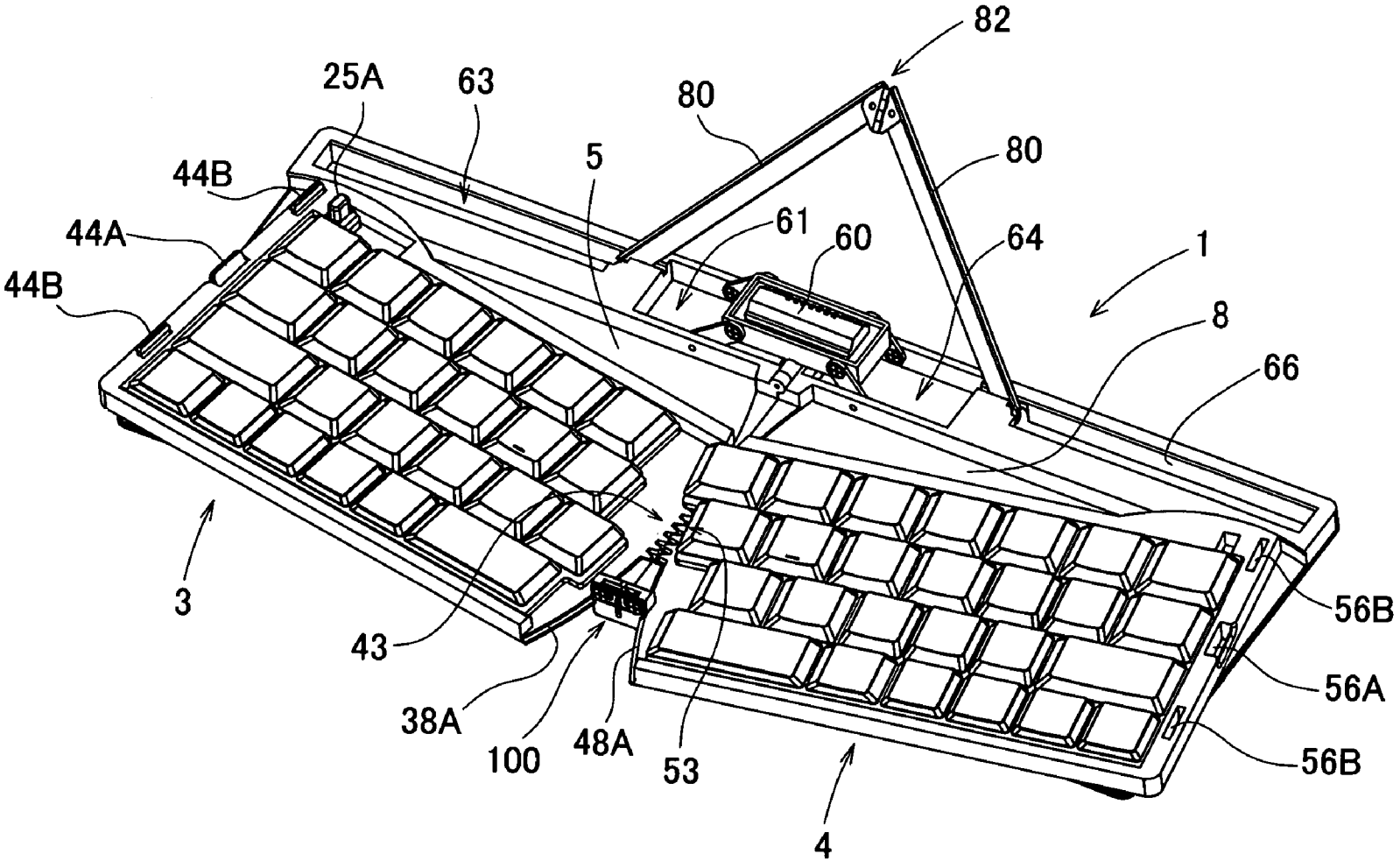
FIG. 8 is a perspective view of the keyboard, in which the first and second keyboard units are turned on a first and second base plates.

When the first key unit 37 including the key switches 7 and the first support plate 6 and the second key unit 47 including the key switches 10 and the second support plate 9 are turned on the first base plate 5 and the second base plate 8 respectively from the position partially shown in FIG. 6, they will be brought into the position shown in FIG. 8. The user may also operate the keyboard 1 in this position if desired.

Figure 9:
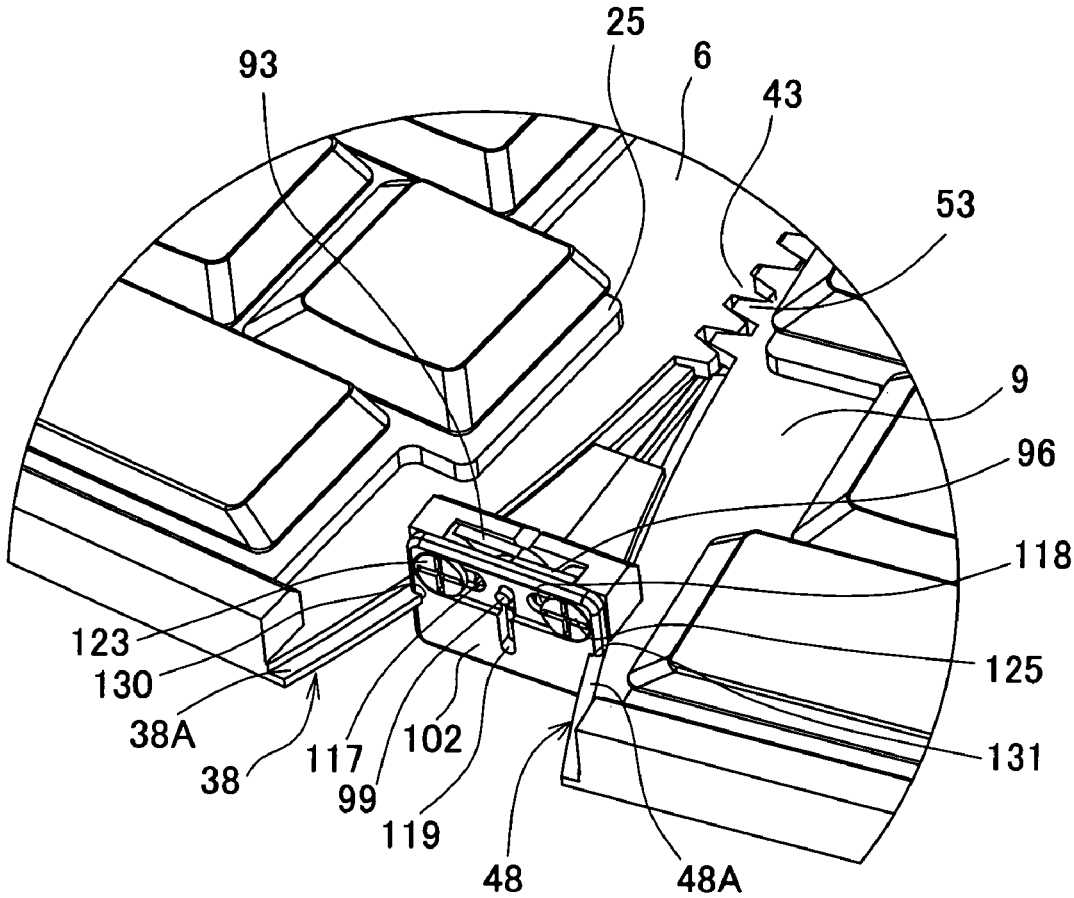
FIG. 9 is an enlarged partial view of the cover in FIG. 8.

FIG. 9 is an enlarged view of a part of the cover member 100 in this state. In FIG. 9, the first and second keyboard units 3 and 4 are horizontally arranged as in the case shown in FIGS. 5 and 6. Hence, the support screw 123 is located in the leftmost position in the first slot 117 and the support screw 125 is located in the rightmost position in the second slot 118. The projection 99 of the joint element 97 pivotally jointing the links 93 and 96 of the linkage system 90 is located in the uppermost position in the third slot 119. The links 93 and 96 are continuously held in horizontal alignment with each other. On the other hand, the first key unit 37 and the second key unit 47 are turned at the same time by engagement between the first gear teeth part 43 and the second gear teeth part 53. When the units 37 and 47 are turned, the thin plate part 38A of the circular arc face 38 of the first support plate 6 is caused to slide frontward while remains engaged in the groove 130 formed in the supporting end plate 102 of the cover member 100 and likewise the thin plate part 48A of the circular arc face 48 of the second support plate 9 is caused to slide frontward while remains engaged in the groove 131 formed in the supporting end plate 102.

As shown in FIG. 9, while the first and second key units 37 and 47 are horizontally turned on the first and second base plates 5 and 8 respectively, as mentioned above, the thin plate part 38A of the circular arc face 38 of the first support plate 6 remains engaged in the groove 130 of the supporting end plate 102 and the thin plate part 48A of the circular arc face 48 of the second support plate 9 remains engaged in the groove 131. These engagement relations can prevent the first and second keyboard units 3 and 4 from rotating into a folded state. Consequently, when the first and second keyboard units 3 and 4 are slightly turned horizontally from the state shown in FIG. 5, they are inhibited from rotating to be folded. In other words, the keyboard units 3 and 4 are surely held in the horizontal state without rotating, so that the keyboard 1 can be used even when put on a place other than a desk, for example, on operator's lap.

Figure 10:
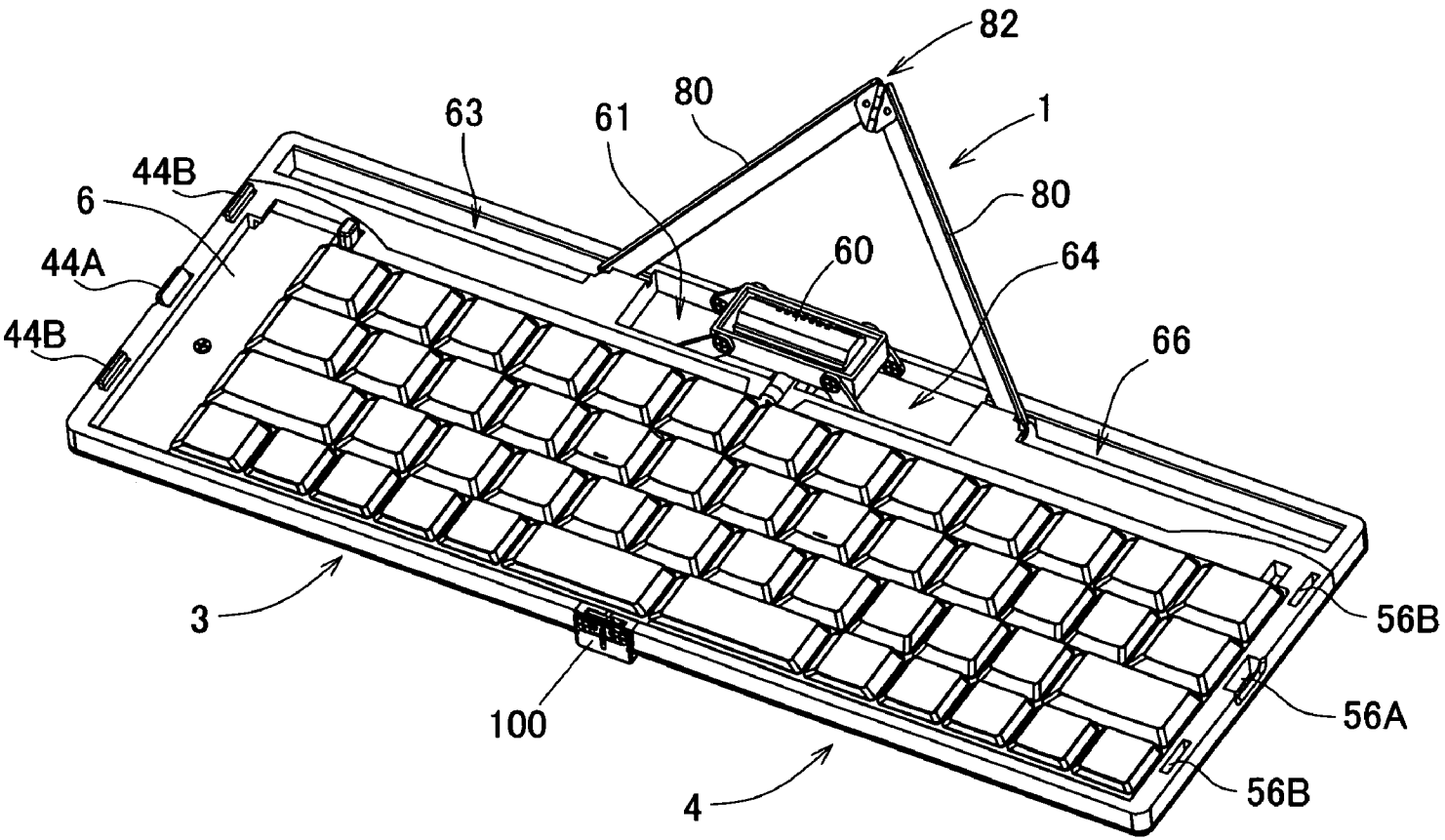
FIG. 10 is a perspective view of the keyboard, in which a key supporting plate of the first keyboard unit is slid from the position shown in FIG. 5.

When the slide knob 25A is grasped and slid by user's fingers in the sliding recess 46B, the key support plate 25 is slid rightward in FIG. 5 together with the key switches 7 mounted thereon. This state is shown in FIG. 10. This sliding of the key support plate 25 brings the stair-like portion 25B into a mated condition with the stair-like portion 26B of the key support plate 26, thus closing a gap between the key switches 7 and 10. Needless to say, the user may also operate the keyboard 1 in this state if desired.

It is to be noted that the first and second keyboard units 3 and 4 in the state shown in FIG. 10 are held in horizontal alignment with each other as in the case shown in FIG. 5. Accordingly, the cover member 100 and the linkage system 90 are held in respective states shown in FIG. 6.

Figure 11:
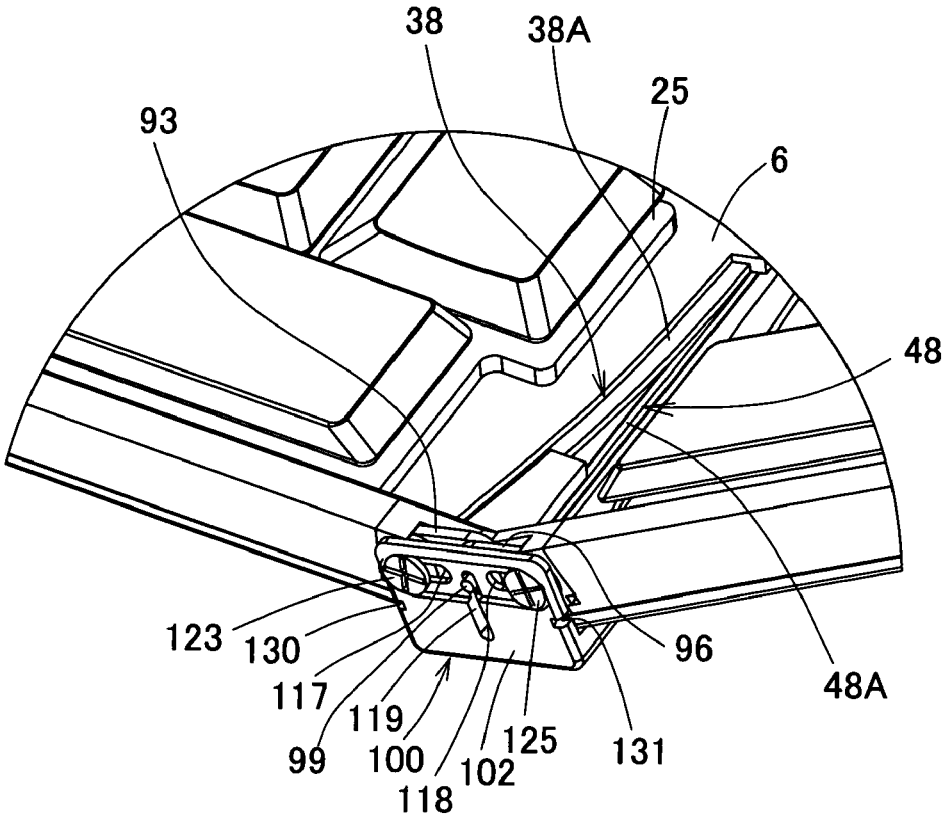
FIG. 11 is an enlarged partial view of the cover placed when the second keyboard unit is slightly rotated from the position in FIG. 5.
Figure 12:
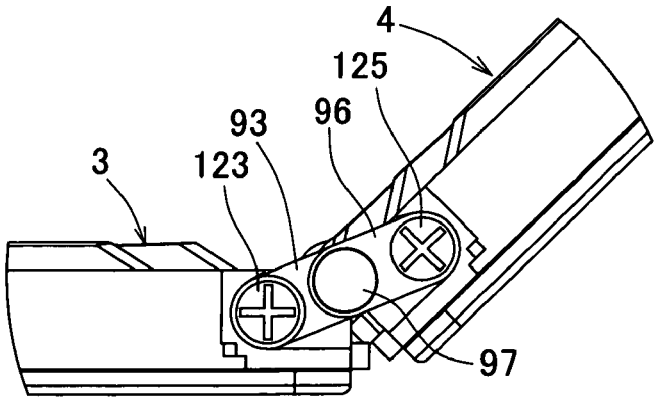
FIG. 12 is an enlarged front view of the linkage system placed when the second keyboard unit is further rotated from the position in FIG. 11.

The folding operation of the first and second keyboard units 3 and 4 from the horizontally arranged state to the mutually superposed state is explained below. When the second keyboard unit 4 is slightly rotated counterclockwise from the position shown in FIG. 5 while the first keyboard unit 3 remains held in a horizontal state, the cover member 100 is simultaneously turned in the same direction as shown in FIG. 11. At this time the support screw 123 is in a slightly rightward position from the leftmost position in the fist slot 117 and the support screw 125 is in a slightly leftward position from the rightmost position in the second slot 118. The projection 99 of the joint element 97 pivotally jointing the links 93 and 96 of the linkage system 90 is in a slightly downward position than the uppermost position in the third slot 119. As shown in FIG. 12, the links 93 and 96 are slightly turned counterclockwise as substantially maintaining a straight relation with each other.

Figure 13:
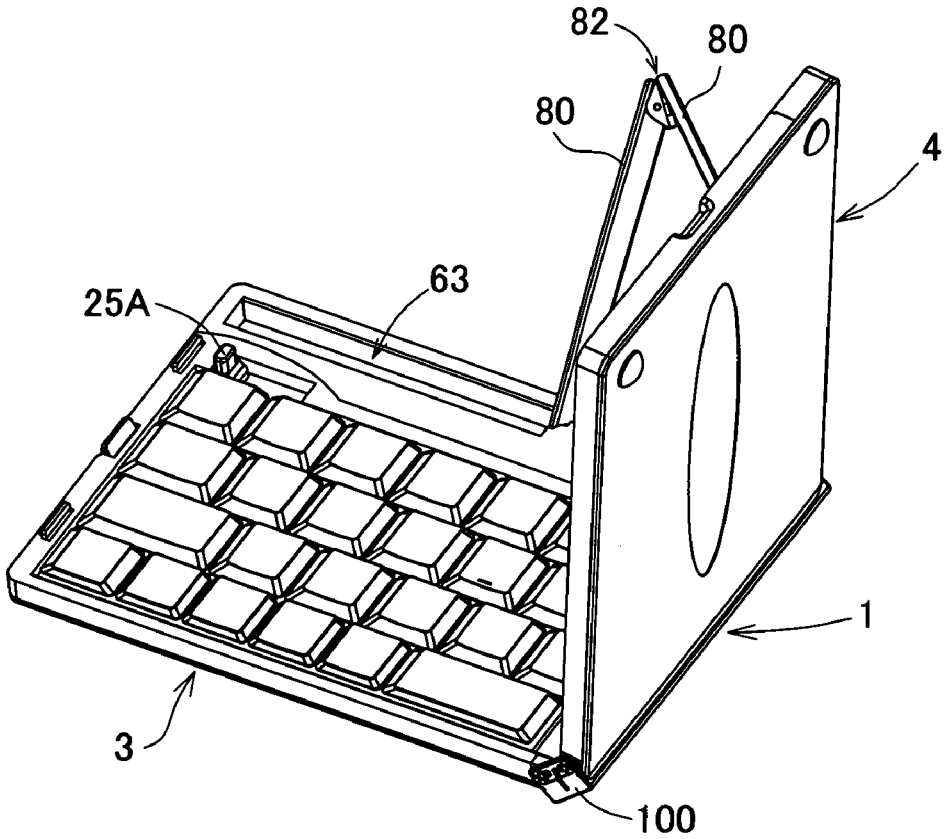
FIG. 13 is a perspective view of the keyboard when the second keyboard unit is further rotated from the position in FIG. 12.

When the second keyboard unit 4 is further rotated counterclockwise to a position at angle of about 90° to the first keyboard unit 3, as shown in FIG. 13, the cover member 100 is turned in the same direction. At this time, the support screw 123 is slid more rightward in the first slot 117 from the position shown in FIG. 11 and the support screw 125 is slid more leftward in the second slot 118 from the position shown in FIG. 11 respectively. The projection 99 of the joint element 97 is slid more downward in the third slot 119 from the position shown in FIG. 11. Simultaneously, the links 93 and 96 are turned, or folded, about the joint element 97 from the straight state, reducing the angle between the links 93 and 96.

Figure 14:
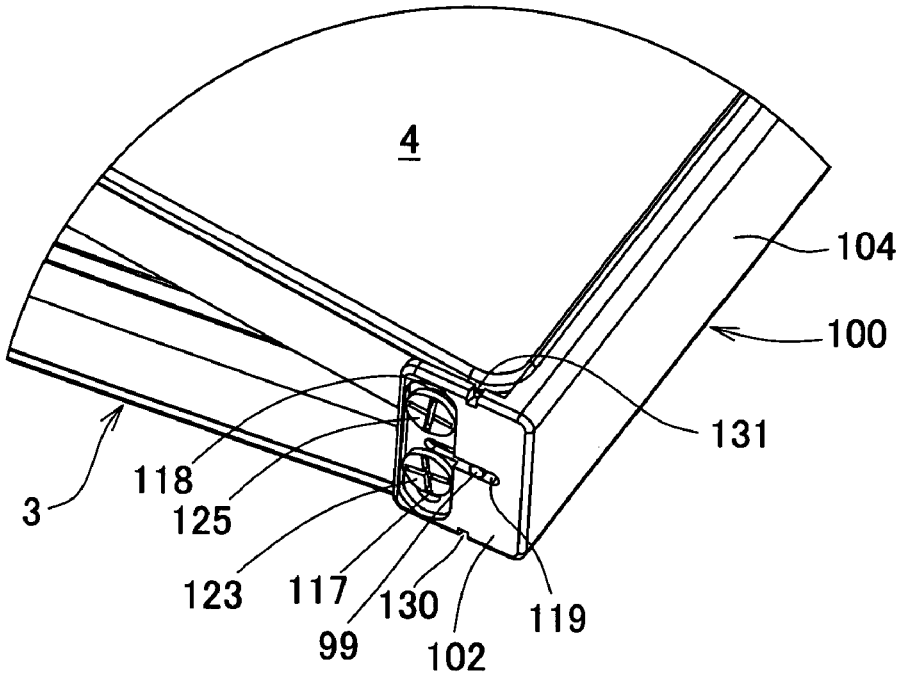
FIG. 14 is an enlarged partial view of the cover placed when the second keyboard is further rotated from the position in FIG. 13.
Figure 15:
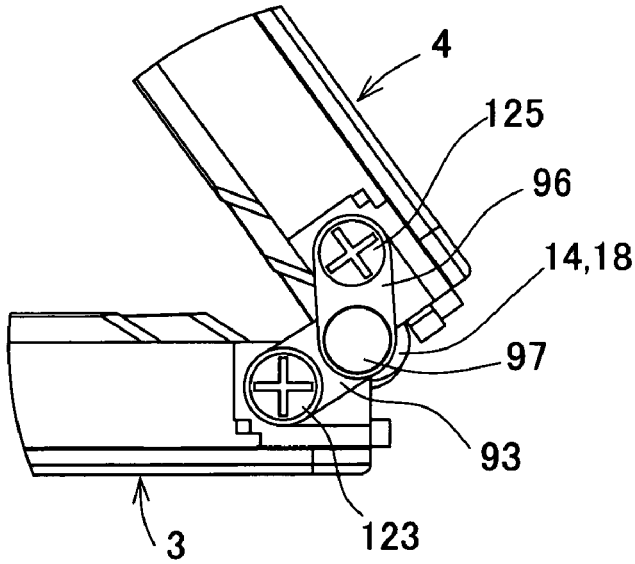
FIG. 15 is a front view of the linkage system in FIG. 14, from which the cover is removed for convenience of explanation.

When the second keyboard unit 4 is still further rotated counterclockwise, it is brought into a state shown in FIGS. 14 and 15. The cover member 100 is simultaneously turned in the same direction as shown in FIG. 14. At this time, the support screw 123 is slid close to the rightmost position in the first slot 117 and the support screw 125 is slid close to the leftmost position in the second slot 118. The projection 99 of the joint element 97 is slid close to the lowermost position in the third slot 119. The links 93 and 96 of the linkage system 90 are further turned, or folded, about the joint element 97 as shown in FIG. 15, further reducing the angle between the links 93 and 96.

Figure 16:
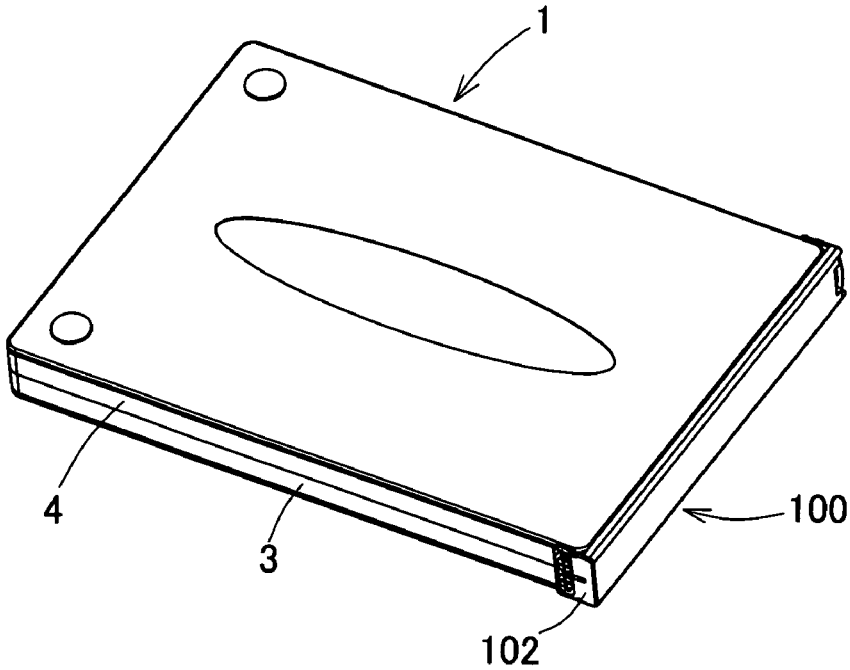
FIG. 16 is a perspective view of the keyboard in a completely folded state where the first and second keyboard units are superposed one on top of the other.
Figure 17:
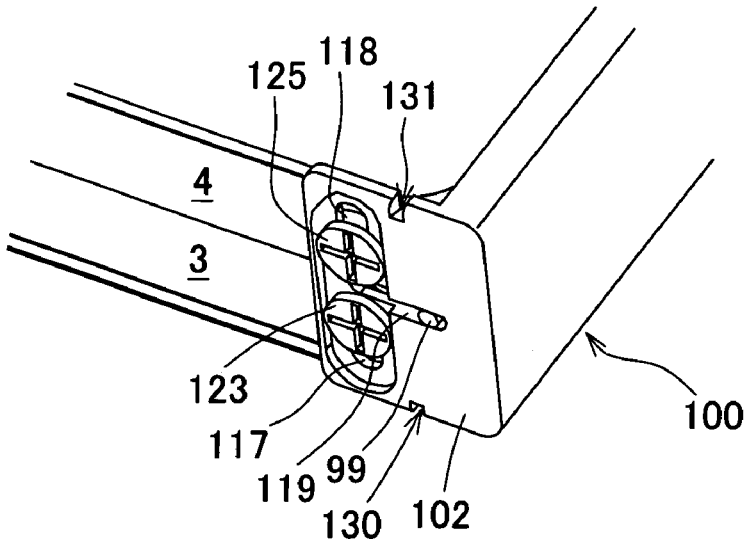
FIG. 17. is an enlarged partial view of the cover in FIG. 16.

Finally, the second keyboard unit 4 is superposed on the first keyboard unit 3 into a completely folded state as shown in FIG. 16. Simultaneously, the cover member 100 is turned to a position shown in FIG. 17 at an angle of 90° with respect to the position shown in FIG. 6. At this time, the support screw 123 is slid to the rightmost position in the first slot 117, the support screw 125 is slid to the leftmost position in the second slot 118, and the projection 99 of the joint element 97 is slid to the lowermost position in the third slot 119, respectively. The links 93 and 96 of the linkage system 90 are further turned, or folded, about the joint element 97 into the state shown in FIG. 18.

As explained above, in the keyboard 1 in the present embodiment, the cover member 100 includes the cover part 101 constructed of the cover plate 104 and the pair of supporting end plates 102 and 103 formed on both ends of the cover plate 104. Each supporting end plate 102 and 103 is formed with the first and second slots 117 and 118. The support screw 123 having passed, with play, or clearance, through the first slot 117 is received in the bearing seat 13A of the bearing member 13 formed in the corner 12B of the first keyboard unit 3. The support screw 124 having passed, with play, or clearance, through the other first slot 117 is fixedly received as a turning axis in the support hole 121 in the corner 12A of the first base plate 5. Similarly, the support screw 125 having passed, with play, or clearance, through the second slot 118 is received in the bearing hole 17A of the bearing member 17 formed in the corner 16B of the second keyboard unit 4. The support screw 126 having passed, with play, or clearance, through the other second slot 118 is fixedly received as a turning axis in the support hole 120 in the corner 16A of the second base plate 8. By cooperation between the support screws 123 and 124 and the first slots 117 and between the support screws 125 and 126 and the second slots 118, the cover member 100 is turned in synchronization with the rotation of the first and second keyboard units 3 and 4. In the superposed state of the units 3 and 4, the cover part 101 of the cover member 100 covers the end faces of the units 3 and 4 and the supporting end plates 102 and 103 of the cover member 100 cover the side portions of lengthwise ends of each end face of the units 3 and 4 (namely, the front and back side portions of each unit). Accordingly, it is possible to prevent dust and waterdrops from entering the keyboard 1 through the end faces of the units 3 and 4 and the side portions of the lengthwise ends of each end face and also to provide a good appearance of the keyboard 1.

While the first and second keyboard units 3 and 4 are rotated from the horizontal state to the superposed state, the cover part 101 of the cover member 100 covers the end faces of the units 3 and 4 and the supporting end plates 102 and 103 cover the side portions of lengthwise ends of each end face of the units 3 and 4. This makes it possible to reliably prevent dust and waterdrops from entering the keyboard 1 from the end faces of the units 3 and 4 and the side portions of lengthwise ends of each end face in any state of the keyboard 1; that is, in a usable state, in the course of folding, or in a folded state for carrying.

Furthermore, the link 93 is turned about the support screw 123 passing with play through the first slot 117 in the supporting end plate 102 of the cover member 100. The link 96 is turned about the screw 125 passing with play through the second slot 118 in the supporting end plate 102. And the links 93 and 96 are jointed to each other to be turnable about the joint rod 98 of the joint element 97. Based on the cooperation between the support screw 123 and the first slot 117 and between the support screw 125 and the second slot 118, the cover member 100 can smoothly be turned through the linkage action of the links 93 and 96. Thus, the first and second keyboard units 3 and 4 can stably be rotated with respect to each other.

The projection 99 in the joint rod 98 of the joint element 97 pivotally jointing the links 93 and 96 is slidably mounted in the third slot 119 in the supporting end plate 102 perpendicular to the first and second slots 117 and 118. Therefore, the projection 99 is caused to slide in the third slot 119 even during the rotation of the first and second keyboard units 3 and 4. Accordingly, the keyboard units 3 and 4 are rotated symmetrically with respect to the third slot 119. This makes it possible to ensure the stable rotation of the keyboard units 3 and 4.

Figure 18:
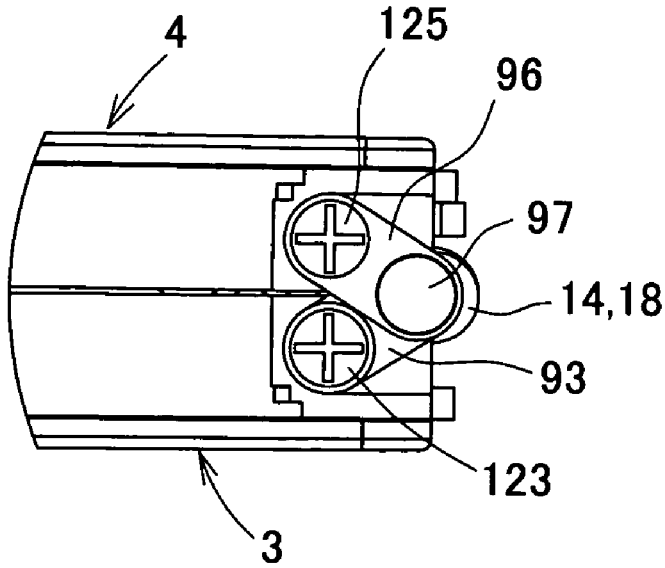
FIG. 18 is a front view of the linkage system in FIG. 17, from which the cover is removed for convenience of explanation.

Furthermore, as mentioned above, the linkage system 90 has the following structure. When the first and second keyboard units 3 and 4 are opened in the horizontally arranged state, the joint rod 98 of the joint element 97 jointing the links 93 and 96 is positioned below the rotation rod 19. When the keyboard units 3 and 4 are folded, on the other hand, the joint rod 98 is substantially aligned with the rotation rod 19 as shown in FIG. 18. Thus, it is unnecessary to provide an upward protrusion at the front of the keyboard 1 like the bearings 14B and 18B for the rotation rod 19. The operationality of the keyboard 1 can be enhanced accordingly.

As explained with reference to FIG. 8, the first and second keyboard units 3 and 4 in the horizontally arranged state are allowed to be turned horizontally (about the screws 29 and 32) on the first and second base plates 5 and 8 respectively, whereas they are prevented from turning except in the horizontally arranged state. This is explained with reference to FIGS. 19A–19C.

Figure 19:
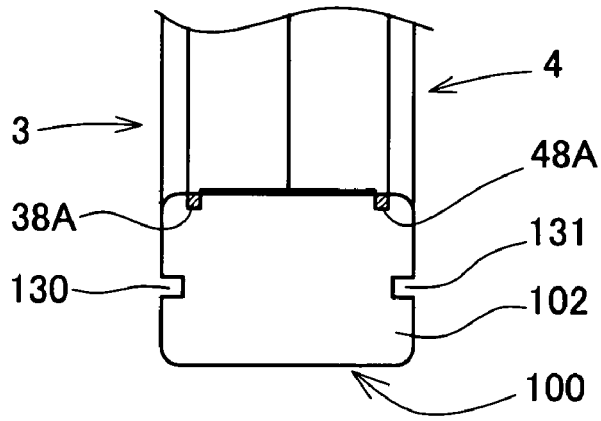
FIGS. 19A to 19C are explanatory views to sequentially show motions of the first and second keyboard units from a folded state to a horizontally arranged position.
Figure 19:
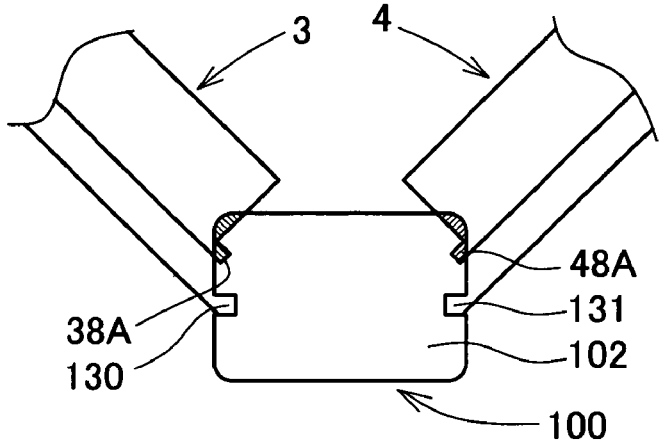
Figure 19:
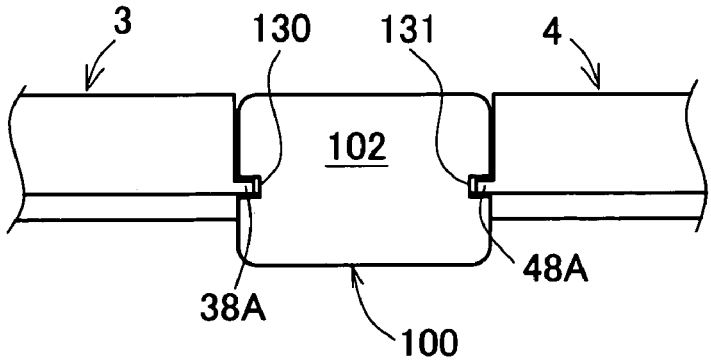

When the first and second keyboard units 3 and 4 are folded into the superposed state, the thin plate part 38A formed in the circular arc face 38 of the first support plate 6 and the thin plate part 48A formed in the circular arc face 48 of the second support plate 9 are in contact with the supporting end plate 102 of the cover member 100 as shown in FIG. 19A. In this state, the keyboard units 3 and 4 are inhibited from turning. While the keyboard units 3 and 4 are in the course of opening from the folded position to the horizontally arranged state, the thin plate parts 38A and 48A are in contact with the supporting end plate 102 of the cover member 100 as shown in FIG. 19B. Also, parts of the keyboard units 3 and 4 are in contact with the supporting end plate 102. In this state, similarly, the keyboard units 3 and 4 are inhibited from turning. When the keyboard units 3 and 4 are fully opened into the horizontally arranged state, the thin plate parts 38A and 48A become engaged in the grooves 130 and 131 respectively in the supporting end plate 102 as shown in FIG. 19C. In this state, the keyboard units 3 and 4 are permitted to turn on the first and second base plates 5 and 8 respectively.

With this structure, the turning of the keyboard units 3 and 4 on the first and second base plates 5 and 8 are inhibited as long as the keyboard units 3 and 4 are in the superposed, folded state and also in the course of opening from the folded state to the horizontal state. Accordingly, during carrying or transport, for example, the keyboard units 3 and 4 in the folded state can be prevented from unexpectedly turning to protrude outside.

The engagement between the first gear teeth part 43 in the circular arc face of the first support plate 6 and the second gear teeth part 53 in the circular arc face of the second support plate 9 is released when the keyboard 1 is folded. However, in this folded keyboard 1, the turning of the first and second keyboard units 3 and 4 is prevented as mentioned above. Accordingly, a proper engagement relation between the first and second gear teeth parts 43 and 53 can be reestablished when the keyboard units 3 and 4 are opened into the horizontally arranged state.

Figure 20:
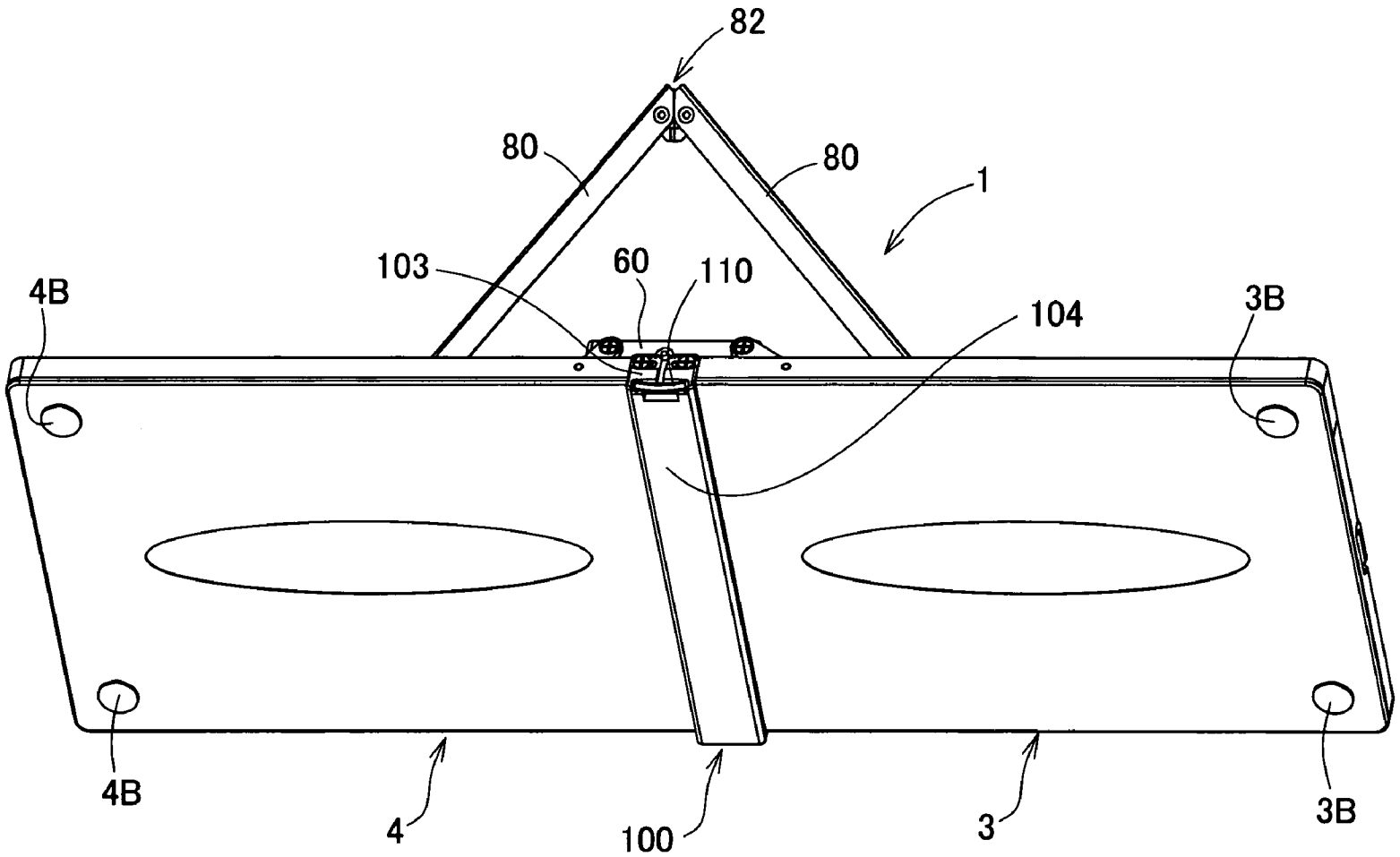
FIG. 20 is a perspective bottom view of the keyboard in a state shown in FIG. 5.

Next, the operation of the stabilizing member 110 provided in the cover member 100 is explained with reference to FIGS. 20 through 22. FIG. 20 is a perspective bottom view of the keyboard 1 in which the first and second keyboard units 3 and 4 are in a horizontally arranged state and the stabilizing member 110 is retracted in the cover part 101 of the cover member 100.

Figure 21:
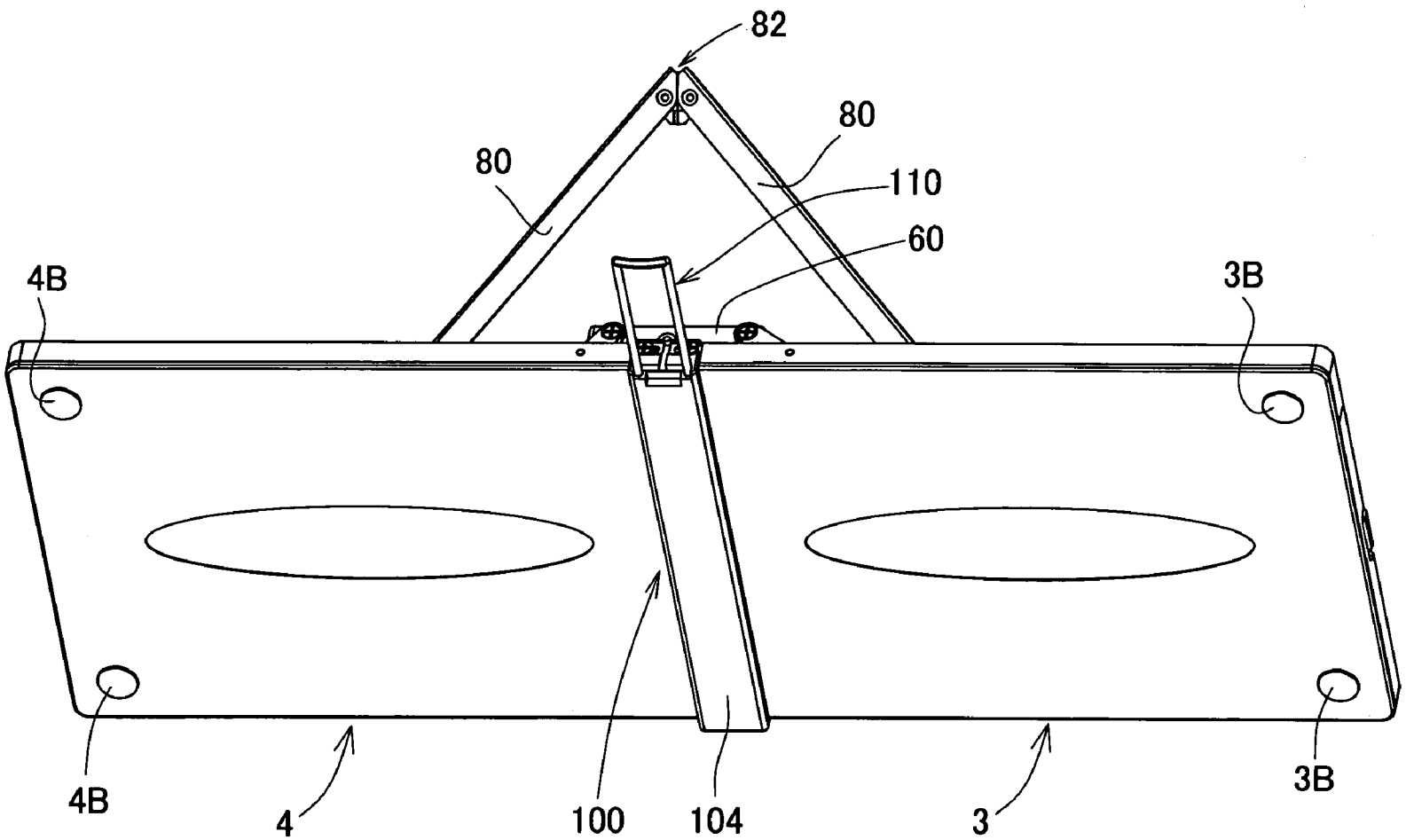
FIG. 21 is a perspective bottom view of the keyboard in FIG. 20, in which a stabilizing member is pulled out.
Figure 22:
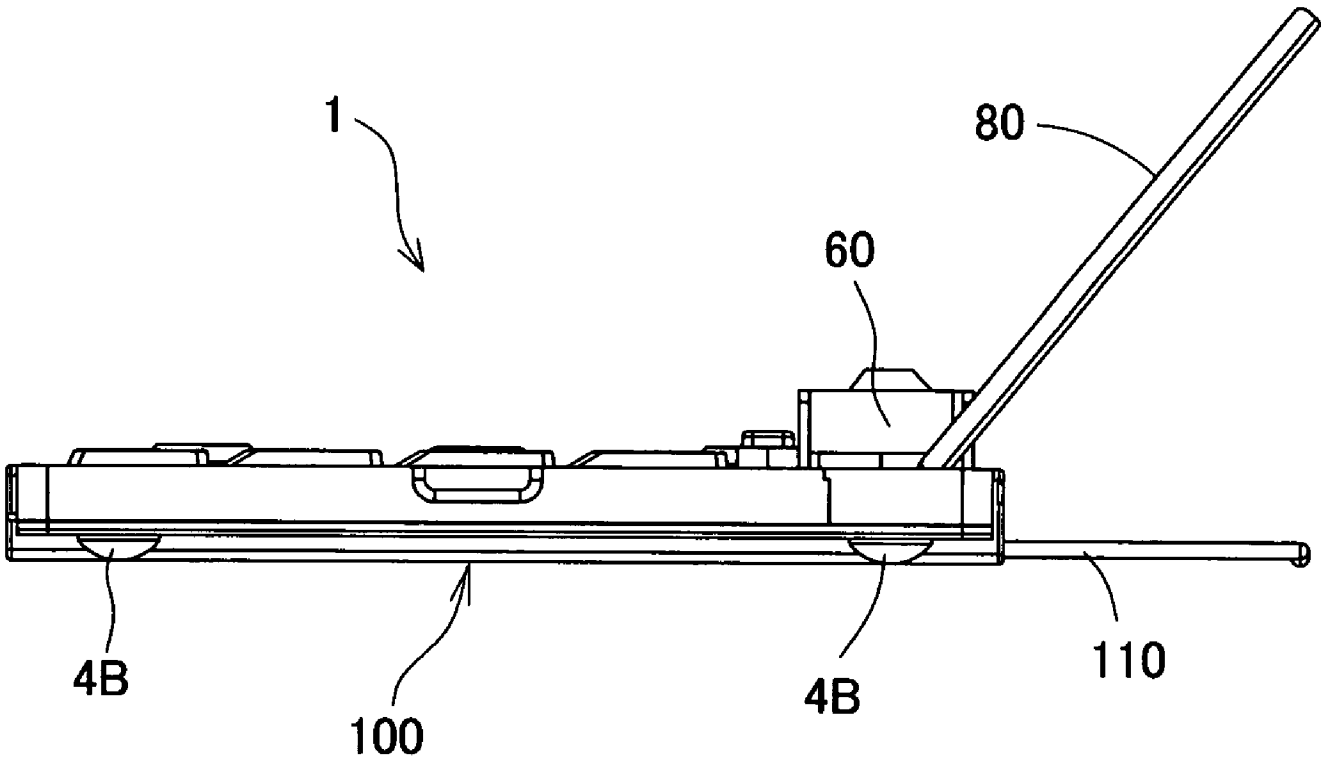
FIG. 22 is a side view of the keyboard in FIG. 21.

In use, the stabilizing member 110 is pulled outside the keyboard 1 as shown in FIGS. 21 and 22. At this time, the rods 111 and 112 are pulled outside, sliding through the sliding holes 108 and 109 in the base parts 106 and 107 of the cover plate 104, until the stopper rings 115 and 116 abut come into contact with the side ends of the base parts 106 and 107.

As mentioned above, the stabilizing member 110 is retracted in the cover part 101 of the cover member 100 in nonuse and is pulled outside in use. The use of such stabilizing member 110 makes it possible to prevent the first and second keyboard units 3 and 4 from so tilting as to partially lift their bottoms from the setting plane due to the weight of the compact portable device (e.g., a PDA) set on the support members 80, 80 in the standing orientation when the first and second keyboard units 3 and 4 are opened in the horizontally arranged state. Thus, the keyboard 1 can be stably held.

The present invention may be embodied in other specific forms without departing from the spirit or essential characteristics thereof. For instance, the following modifications may be adopted.

Figure 23:
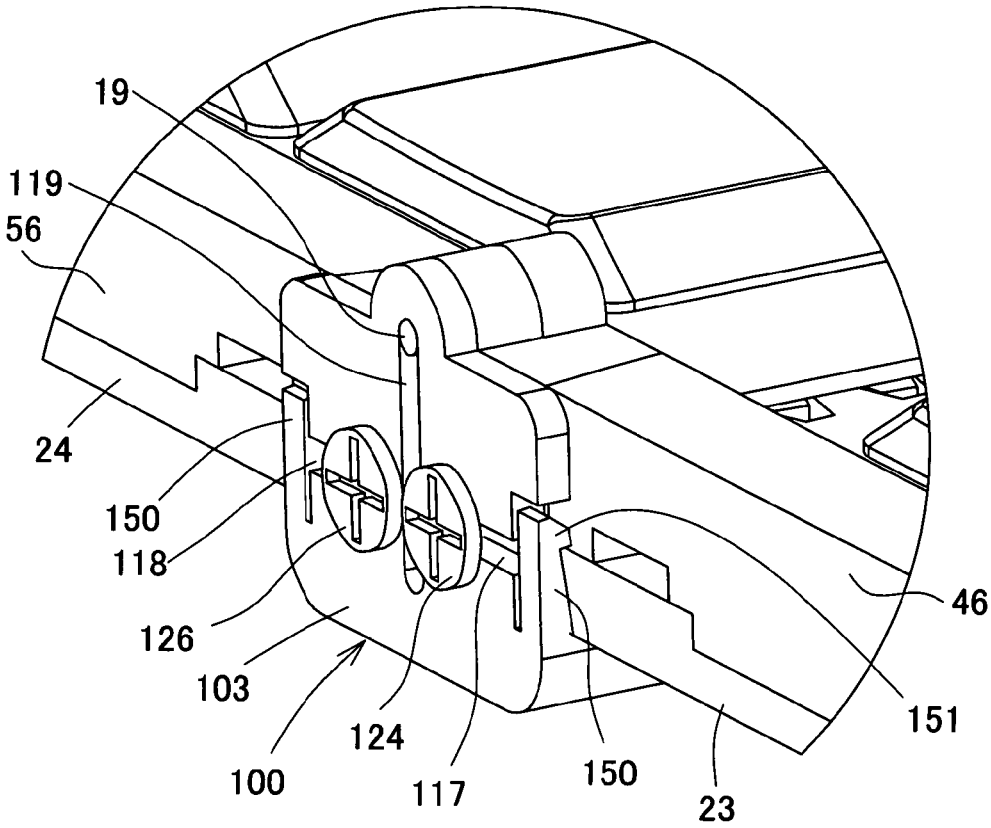
FIG. 23 is an enlarged partial view of a cover member shown as another variation.
Figure 24:
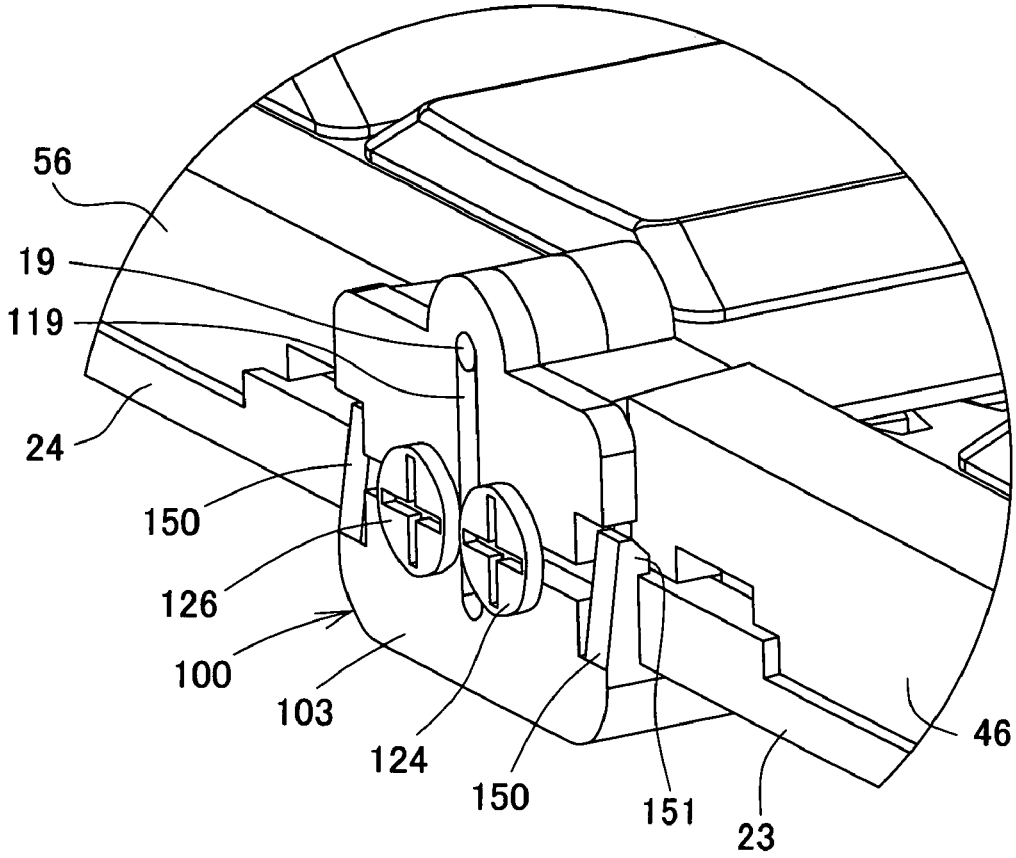
FIG. 24 is an enlarged partial view of the cover in FIG. 23 in another state.

For instance, in the above embodiment, when the first and second key units 37 and 47 are horizontally turned with respect to the first and second base plates 5 and 8 respectively, the thin plate parts 38A in the circular arc face 38 of the first support plate 6 is engaged in the groove 130 of the supporting end plate 102 and the thin plate part 48A in the circular arc face 48 of the second support plate 9 is engaged in the groove 131. In this state, the first and second keyboard units 3 and 4 are inhibited from rotating, or folding, into the superposed state. Thus, the keyboard units 3 and 4 can surely be held in the horizontally open state. Instead of using the above engagement structure, for example, a pair of elastic locking pawls 150 may be integrally formed with the end plate 103 of the cover member 100 as shown in FIGS. 23 and 24. As long as the keyboard units 3 and 4 are in the horizontally open state (as shown in FIG. 23), pawl ends 151 of the pawls 150 are held in contact with the back walls of the peripheral member 46 of the first support plate 6 and the peripheral member 56 of the second support plate 9. When the keyboard units 3 and 4 are turned on the first and second base plates 5 and 8 (as shown in FIG. 24), shoulders appear between the frame portion 23 and the peripheral wall 46 in the first base plate 5 and between the frame portion 24 and the peripheral wall 56 in the second base plate 8. At this time, pawl ends 151 of the elastic locking pawls 150 catch the shoulders. With this structure, the keyboard units 3 and 4 when turned on the base plates 5 and 8 are prevented from rotating. Thus, the keyboard units 3 and 4 can be surely held in the horizontally open state.

In the above embodiment, when the keyboard units 3 and 4 are not in the horizontally open state, for example, when they are in the folded state or in the course of rotation from the folded state to the open state, the thin plate part 38A of the circular arc face 38 of the first support plate 6 and the thin plate part 48A of the circular arc face 48 of the second support plate 9 are held in contact with the supporting end plate 102 of the cover member 100, thereby preventing the keyboard units 3 and 4 from turning on the first and second base plates 5 and 8 respectively. Instead of using the above structure, an alternative design shown in FIGS. 25 through 30 may be adopted.

Figure 25:
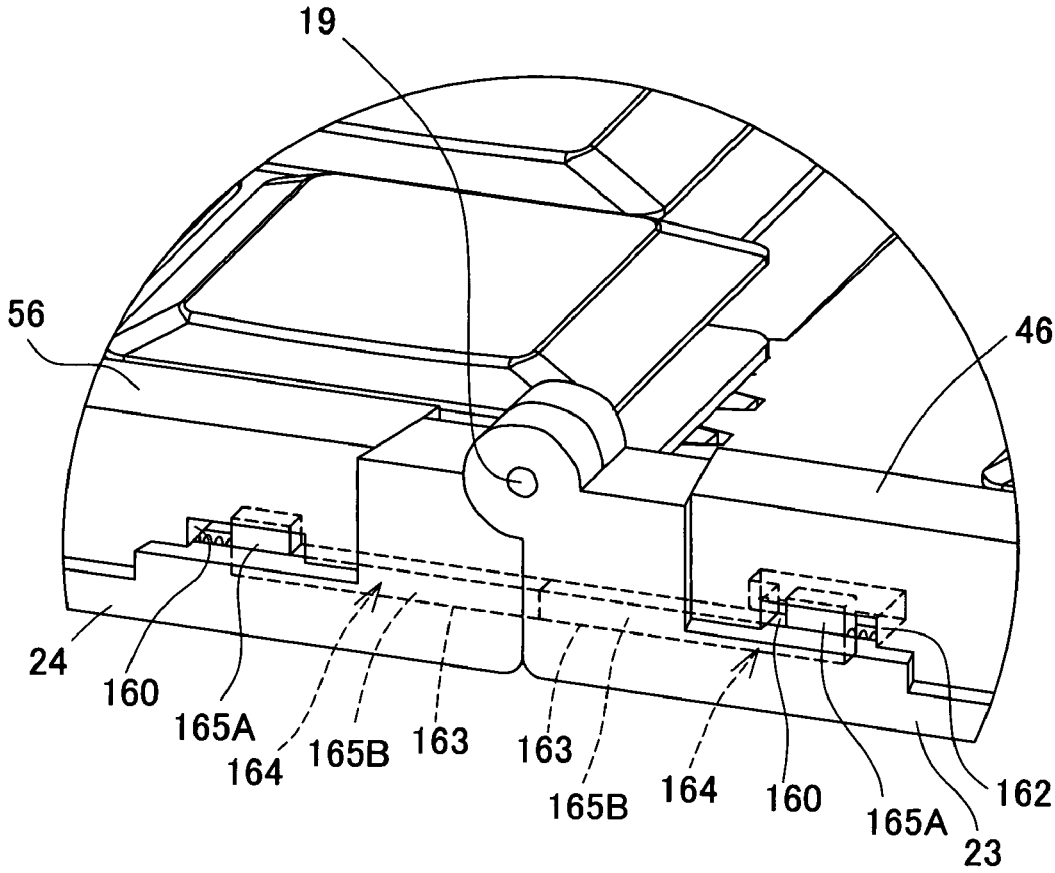
FIG. 25 is an enlarged partial view of the back portion of a keyboard shown as a second variation, in which the first and second keyboard units are horizontally arranged.
Figure 26:
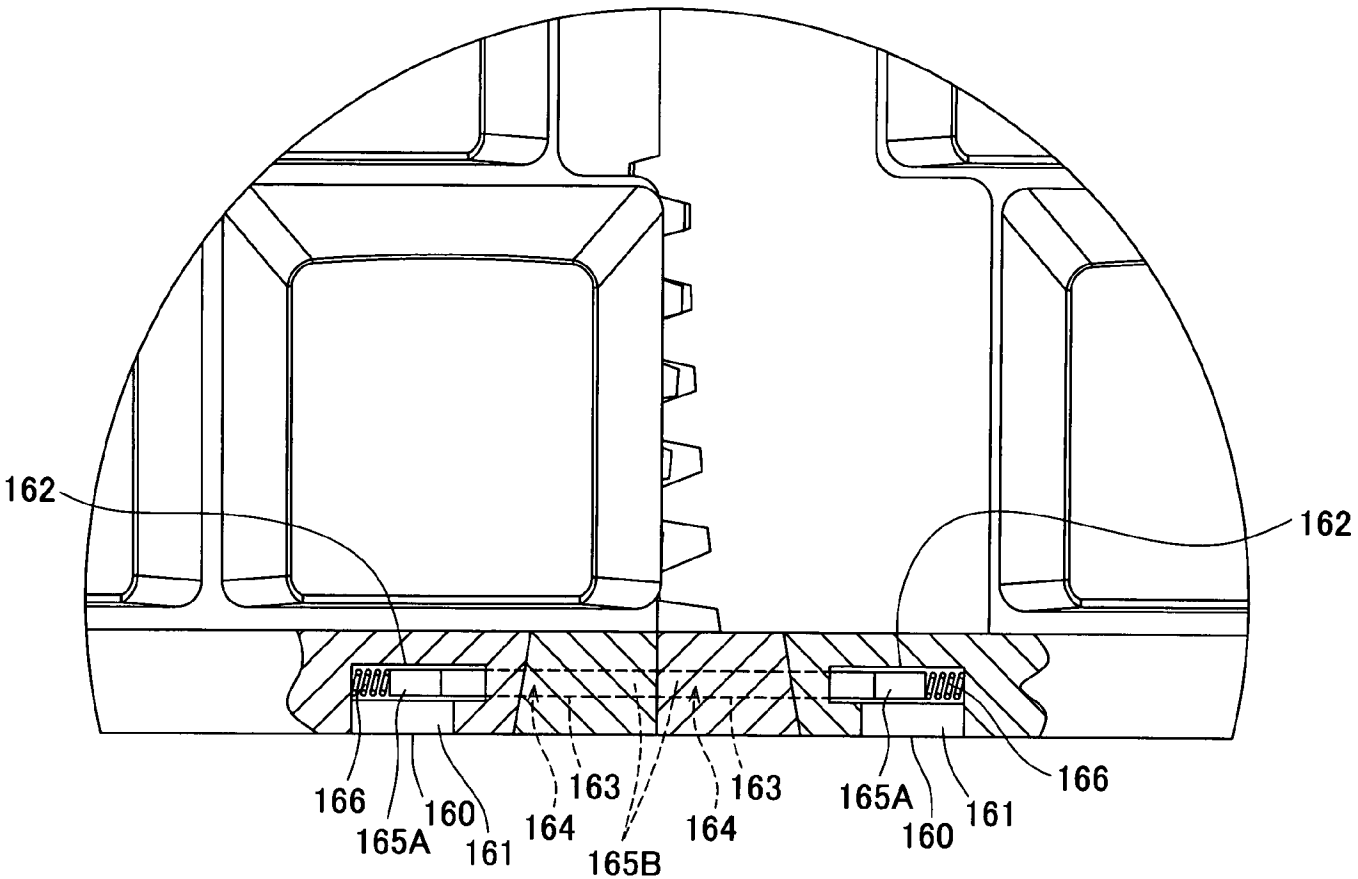
FIG. 26 is an enlarged plan view of the back portion in FIG. 25 with a partially cutaway view.
Figure 27:
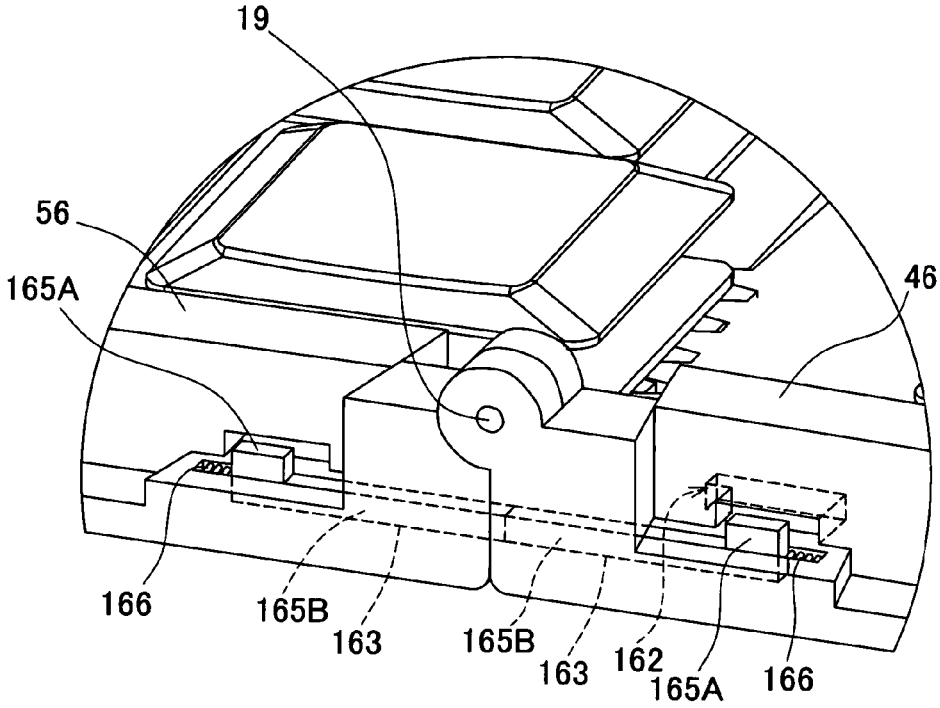
FIG. 27 is an enlarged partial view of the back portion of the keyboard shown in FIG. 25, in which the first and second keyboard units are turned horizontally.
Figure 28:
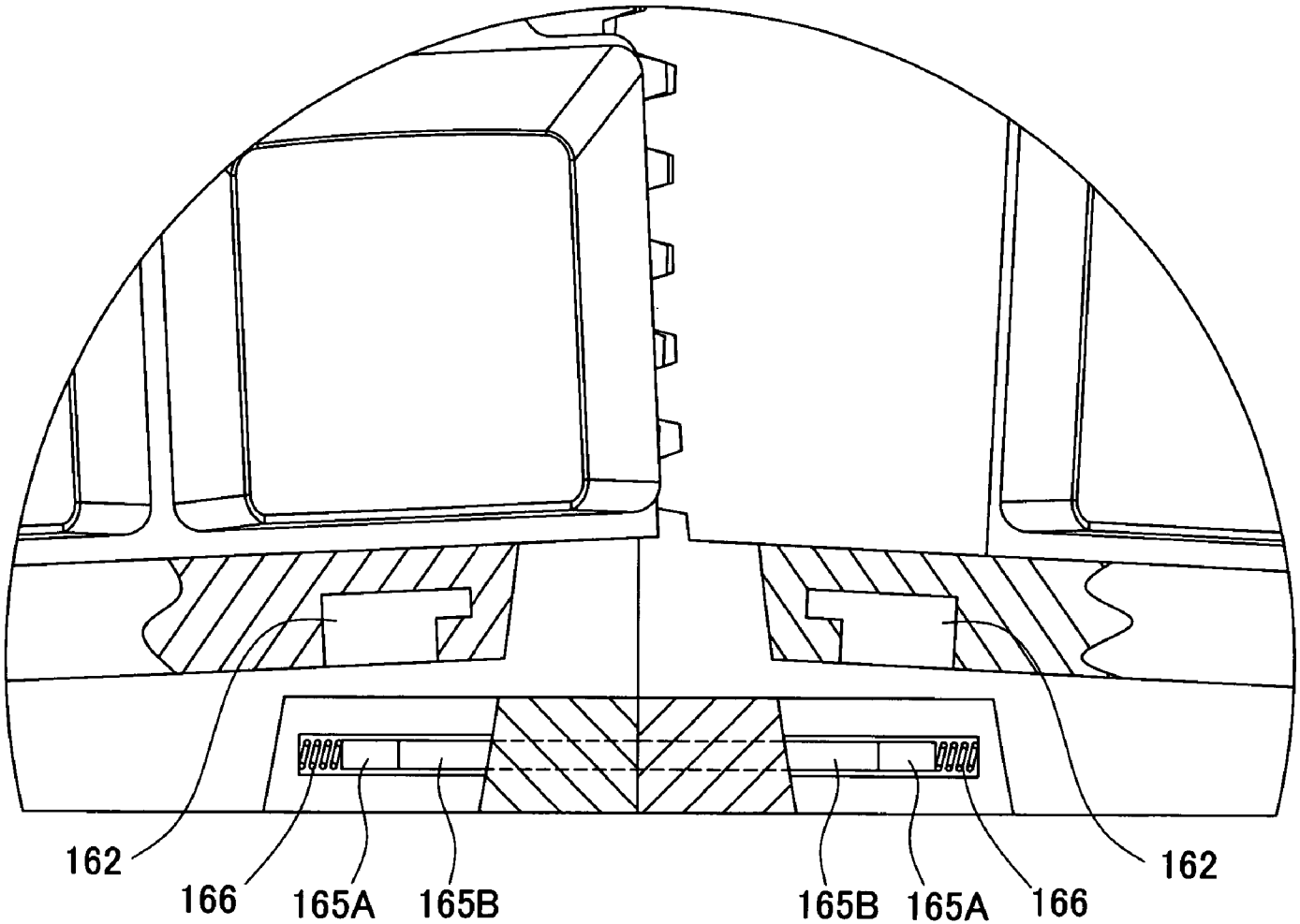
FIG. 28 is an enlarged plan view of the back portion in FIG. 27 with a partially cutaway view.

In this example, as shown in FIGS. 25 and 26, a recess 161 having an opening 160 is formed in each of the back face of the peripheral wall member 46 in the first support plate 6 in the first keyboard unit 3 and the back face of the peripheral wall member 56 in the second support plate 9 in the second keyboard unit 4. Adjacent to the recess 161, a slide locking groove 162 is formed extending longer than the recess 161 toward the rotation rod 19. Under the slide locking groove 162 and integrally therewith, a sliding groove 163 is formed extending to the end face of each keyboard unit 3 and 4 (namely, the end face close to the rotation rod 19).

In the slide locking groove 162 and the sliding groove 163, a slide locking member 164 is slidably mounted with play. That is, the slide locking member 164 is integrally constructed of a projection 165A slidably positioned in the slide locking groove 162 and a sliding shaft 165B formed continuously with the locking projection 165A. This shaft 165B is slidable in the sliding groove 163. In the first keyboard unit 3, a press spring 166 is placed between the right end of the slide locking groove 162 and the right end of the locking projection 165A. In the second keyboard unit 4, similarly, a press spring 166 is placed between the left end of the slide locking groove 162 and the left end of the locking projection 165A.

When the first and second keyboard units 3 and 4 are in the horizontally arranged state, as shown in FIGS. 25 and 26, the end faces of the sliding shafts 165B of the slide locking members 164 abut on each other at the end faces of the keyboard units 3 and 4. In this state, the locking projections 165A are urged in the direction to make the end faces of the sliding shafts 165B abut on each other through the press springs 166. At this time, each locking projection 165A is positioned in the groove 162 at a position corresponding to the opening 160 of the recess 161.

In the horizontally arranged state of the first and second keyboard units 3 and 4, when the first key unit 37 of the first keyboard unit 3 is turned on the first base plate 5 and the second key unit 47 of the second keyboard unit 4 is turned on the second base plate 8, the locking projections 165A of the slide locking members 164 become exposed outside the opening 160 of the recess 161. Thus, when the first and second keyboard units 3 and 4 are in the horizontally arranged state, the first and second key units 37 and 47 can be turned.

Figure 29:
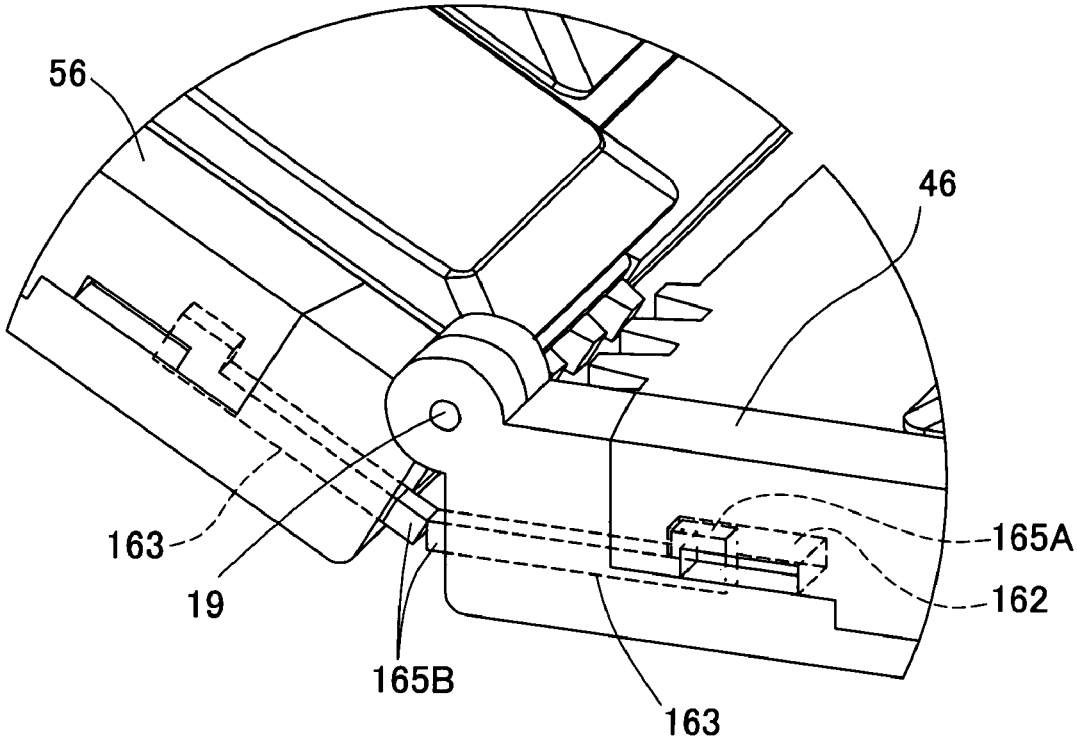
FIG. 29 is an enlarged partial view of the back portion of the keyboard in a state to inhibit rotation of the first and second keyboard units after slightly folded.
Figure 30:
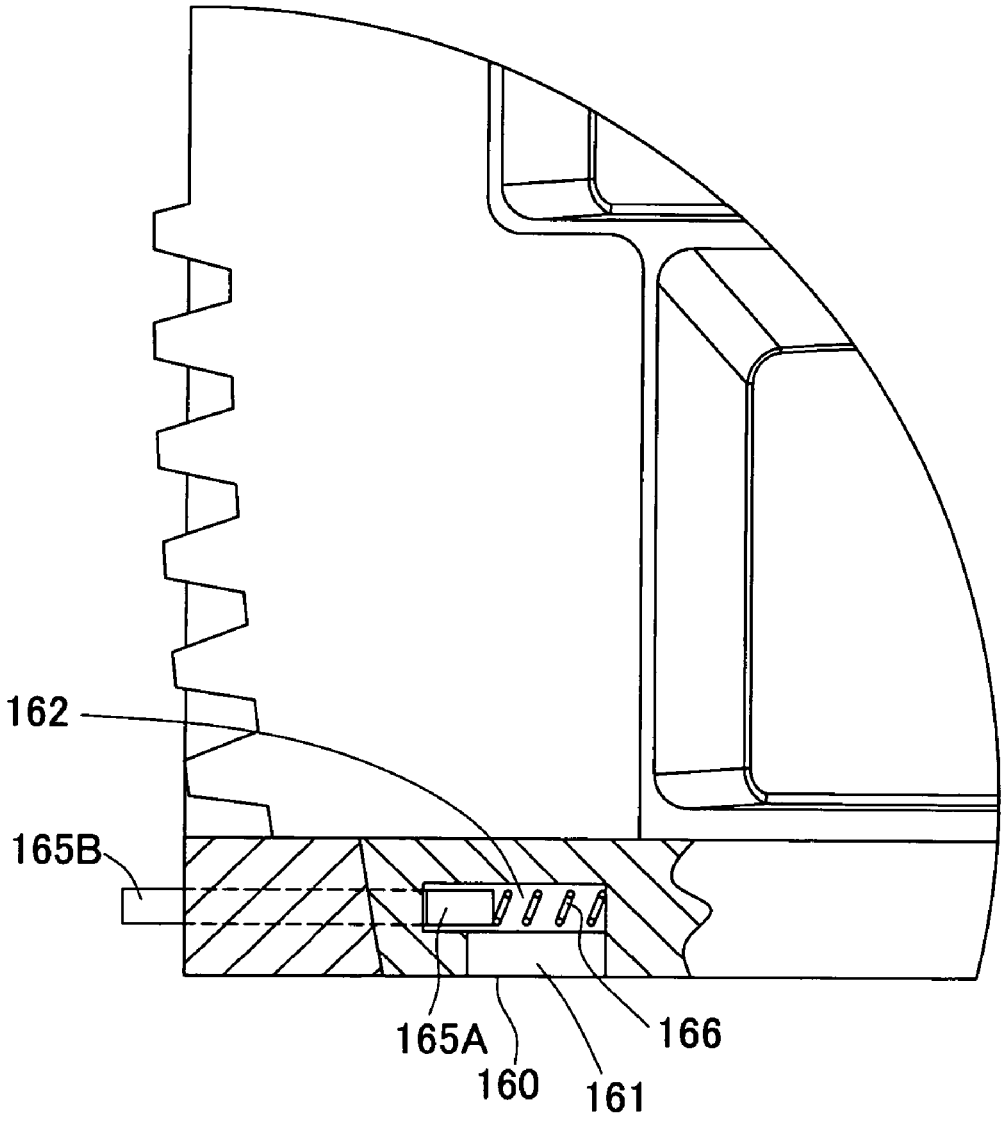
FIG. 30 is a plane view of a part of the first keyboard unit in a position shown in FIG. 29.

On the other hand, when the folding of the first and second keyboard units 3 and 4 is started, as shown in FIGS. 29 and 30, the projections 165A of the slide locking members 164 being pressed by the press springs 166 toward the rotation rod 19 are caused to slide in the slide locking grooves 162 toward the rotation rod 19. Simultaneously, the sliding shafts 165B are caused to slide in the sliding grooves 163 toward the rotation rod 19, so that the end portions of the sliding shafts 165B are exposed outside from the end faces of the first and second keyboard units 3 and 4.

When each slide locking member 164 slides toward the rotation rod 19 as above, one of the locking projections 165A comes into contact with the left end of the slide locking groove 162 in the first keyboard unit 3 and the other locking projection 165A comes into contact with the right end of the slide locking groove 162 in the second keyboard unit 4. Thus, the locking projections 165A are locked at the above respective positions. With this structure, except when the first and second keyboard units 3 and 4 are in the horizontally arranged state, the first and second key units 37 and 47 are inhibited from turning on the first and second base plates 5 and 8 respectively.

Accordingly, when the first and second keyboard units 3 and 4 are in the folded, superposed state, and in the course of opening from the folded state to the horizontally arranged state, the first and second key units 37 and 47 are inhibited from turning on the first and second base plates 5 and 8 respectively. Consequently, during carrying, for example, the keyboard units 3 and 4 in the folded state can be surely prevented from unexpectedly turning to protrude outside.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the keyboard further includes:

first support parts formed in opposite corners in one side of the first keyboard unit;

second support parts formed in opposite corners in one side of the second keyboard unit;

a cover member including a cover part, a pair of supporting elements formed on both ends of the cover part, first slots formed in the supporting elements respectively to correspond to each first support part, and second slots formed in the supporting elements to correspond to each second support part;

first support shafts supported in the first support parts respectively, each first support shaft passing through each first slot with play;

second support shafts supported in the second support parts respectively, each second support shaft passing through each second slot with play;

when the first and second keyboard units are rotated from the horizontally arranged state to the superposed state, the cover member is synchronously turned by cooperation between the first support shafts and the first slots and between the second support shafts and the second slots, and the cover part of the cover member covers end faces of the first and second keyboard units in the superposed state and the support elements of the cover member cover side portions of each end face of the first and second keyboard units.

2. The foldable keyboard according to claim 1, wherein while the first and second keyboard units are rotated from the horizontally arranged state to the superposed state, the cover part of the cover member covers the end faces of the first and second keyboard units and the support elements of the cover member cover the side portions of each end face of the first and second keyboard units.

3. The foldable keyboard according to claim 1 further including:

a first link turnably supported by the first support shaft passing through the first slot with play;

a second link turnably supported by the second support shaft passing through the second slot with play; and a joint rod which pivotally joints the first and second links to allow for turning of the links with respect to each other.

4. The foldable keyboard according to claim 3 further including:

third slots formed in the supporting elements in a perpendicular direction to a longitudinal direction of the first and second slots; and a projection formed in the joint rod and inserted in the third slot with play;

wherein the projection is slid in the third slot in synchronization with the rotation of the first and second keyboard units.

5. A foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the first keyboard unit includes a first base plate and a first unit comprising a first support plate provided to be turnable in a horizontal direction on the first base plate and a plurality of key switches arranged on the first support plate;

the second keyboard unit includes a second base plate and a second unit comprising a second support plate provided to be turnable in a horizontal direction on the second base plate and a plurality of key switches arranged on the second support plate;

the keyboard further includes:

first support parts formed in opposite corners in one side of the first keyboard unit;

second support parts formed in opposite corners in one side of the second keyboard unit;

a cover member including a pair of supporting elements which are turnably connected with the first and second support parts respectively so that the cover member covers end faces of the first and second keyboard units in the superposed state; and a pair of grooves which are formed on both sides of one of the support elements and in which circular arc faces of the first and second support plates are slidably engaged.

6. The foldable keyboard according to claim 5 further including:

first slots formed in the supporting elements respectively to correspond to each first support part;

second slots formed in the supporting elements respectively to correspond to each second support part;

first support shafts supported in the first support parts, each first support shaft passing through each first slot with play; and second support shafts supported in the second support parts respectively, each second support shaft passing through each second slot with play.

7. The foldable keyboard according to claim 6 further including:

a first link turnably supported by the first support shaft passing through the first slot with play;

a second link turnably supported by the second support shaft passing through the second slot with play; and a joint rod which pivotally joints the first and second links to allow for turning of the links with respect to each other.

8. The foldable keyboard according to claim 7 further including:

third slots formed in the supporting elements in a perpendicular direction to a longitudinal direction of the first and second slots; and a projection formed in the joint rod and inserted in the third slot with play;

wherein the projection is slid in the third slot in synchronization with the rotation of the first and second keyboard units.

9. A foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the first keyboard unit includes a first base plate and a first unit comprising a first support plate provided to be turnable in a horizontal direction on the first base plate and a plurality of key switches arranged on the first support plate;

the second keyboard unit includes a second base plate and a second unit comprising a second support plate provided to be turnable in a horizontal direction on the second base plate and a plurality of key switches arranged on the second support plate;

the keyboard further includes:

first support parts formed in opposite corners in one side of the first keyboard unit;

second support parts formed in opposite corners in one side of the second keyboard unit;

a cover member including a pair of supporting elements which are turnably connected to the first and second support parts respectively so that the cover member covers end faces of the first and second keyboard units in the superposed state; and the cover member inhibits turning of the first and second support plates in the superposed state and in course of rotation from the superposed state to the horizontally arranged state.

10. The foldable keyboard according to claim 9 further including:

first slots formed in the supporting elements respectively to correspond to each first support part;

second slots formed in the supporting elements respectively to correspond to each second support part;

first support shafts supported in the first support parts, each first support shaft passing through each first slot with play; and second support shafts supported in the second support parts respectively, each second support shaft passing through each second slot with play.

11. The foldable keyboard according to claim 10 further including:

a first link turnably supported by the first support shaft passing through the first slot with play;

a second link turnably supported by the second support shaft passing through the second slot with play; and a joint rod which pivotally joints the first and second links to allow for turning of the links with respect to each other.

12. The foldable keyboard according to claim 11 further including:

third slots formed in the supporting elements in a perpendicular direction to a longitudinal direction of the first and second slots; and a projection formed in the joint rod and inserted in the third slot with play;

wherein the projection is slid in the third slot in synchronization with the rotation of the first and second keyboard units.

13. A foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the keyboard further includes:

first support parts formed in opposite corners in one side of the first keyboard unit;

second support parts formed in opposite corners in one side of the second keyboard unit;

a first link turnably supported in the first support part through the first support shaft;

a second link turnably supported in the second support part through the second support shaft; and a joint rod which pivotally joints the first and second links to allow for turning of the links with respect to each other.

14. The foldable keyboard according to claim 13, wherein the foldable keyboard further includes a cover member including a cover part, a pair of supporting elements formed on both ends of the cover part, first slots formed in the supporting elements respectively to correspond to each first support part, and second slots formed in the supporting elements to correspond to each second support part;

the first support shaft passes through the first slot with play and is supported in the first support part;

the second support shaft passes through the second slot with play and is supported in the second support part;

when the first and second keyboard units are rotated from the horizontally arranged state to the superposed state, the cover member is synchronously turned by cooperation between the first support shafts and the first slots and between the second support shafts and the second slots; and the cover part of the cover member covers end faces of the first and second keyboard units in the superposed state.

15. The foldable keyboard according to claim 14 further including:

third slots formed in the supporting elements in a perpendicular direction to a longitudinal direction of the first and second slots; and a projection formed in the joint rod and inserted in the third slot with play;

wherein the projection is slid in the third slot in synchronization with the rotation of the first and second keyboard units.

16. A foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the keyboard further includes:

first support parts formed in opposite corners in one side of the first keyboard unit;

second support parts formed in opposite corners in one side of the second keyboard unit;

a cover member including a pair of supporting elements which are turnably connected to the first and second support parts respectively and a cover part formed between the supporting elements, the cover member being adapted to cover end faces of the first and second keyboard units in the superposed state;

a device support member which is raised to a standing orientation in conjunction with the rotation of the first and second keyboard units in a direction that they come apart; and a keyboard stabilizing member provided in the cover part of the cover member so that the stabilizing member is pulled in an axial direction of the rotation rod to outside of the first and second keyboard units;

the keyboard stabilizing member is in a pulled state outside the first and second keyboard units while the device support member supports a device to prevent the first and second keyboard units from so tilting as to partially lift their bottoms from a setting plane.

17. The foldable keyboard according to claim 16 further including:

first slots formed in the supporting elements respectively to correspond to each first support part;

second slots formed in the supporting elements respectively to correspond to each second support part;

first support shafts supported in the first support parts, each first support shaft passing through each first slot with play; and second support shafts supported in the second support parts respectively, each second support shaft passing through each second slot with play.

18. The foldable keyboard according to claim 17 further including:

a first link turnably supported by the first support shaft passing through the first slot with play;

a second link turnably supported by the second support shaft passing through the second slot with play; and a joint rod which pivotally joints the first and second links to allow for turning of the links with respect to each other.

19. The foldable keyboard according to claim 18 further including:

third slots formed in the supporting elements in a perpendicular direction to a longitudinal direction of the first and second slots; and a projection formed in the joint rod and inserted in the third slot with play;

wherein the projection is slid in the third slot in synchronization with the rotation of the first and second keyboard units.

20. A foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the first keyboard unit includes a first base plate with a first frame portion and a first unit comprising a first support plate with a first wall member provided to be turnable in a horizontal direction on the first base plate and a plurality of key switches arranged on the first support plate;

the second keyboard unit includes a second base plate with a second frame portion and a second unit comprising a second support plate with a second wall member provided to be turnable in a horizontal direction on the second base plate and a plurality of key switches arranged on the second support plate;

the keyboard further includes:

first support parts formed in opposite corners in one side of the first keyboard unit;

second support parts formed in opposite corners in one side of the second keyboard unit;

a cover member including a pair of support elements which are turnably connected to the first and second support parts respectively so that the cover member covers end faces of the first and second keyboard units in the superposed state; and a pair of first and second pawl members formed in one of the support elements of the cover member, each pawl member having pawl on a top end thereof;

wherein the pawl of the first pawl member contacts with a wall plane of the first wall member and the pawl of the second pawl member contacts with a wall plane of the second wall member when the first and the second keyboard unit are horizontally arranged with each other, and wherein the pawl of the first pawl member engages with a shoulder formed between the first frame portion and the first wall member and the pawl of the second pawl member engages with a shoulder formed between the second frame portion and the second wall member, when the first support plate is turned in the horizontal direction on the first base plate and the second support plate is turned in the horizontal direction on the second base plate, thereby the first and second keyboard units are inhibited from folding thereof.

21. A foldable keyboard including a first keyboard unit and a second keyboard unit which are rotatably connected by a rotation rod so that the first and second keyboard units are rotated about the rotation rod to come apart from each other into an unfolded, horizontally arranged state for use of the keyboard, whereas the first and second keyboard units are rotated about the rotation rod to come close to each other into a folded, superposed state for nonuse of the keyboard, wherein the first keyboard unit includes a first base plate with a first frame portion and a first unit comprising a first support plate with a first wall member provided to be turnable in a horizontal direction on the first base plate and a plurality of key switches arranged on the first support plate;

the second keyboard unit includes a second base plate with a second frame portion and a second unit comprising a second support plate with a second wall member provided to be turnable in a horizontal direction on the second base plate and a plurality of key switches arranged on the second support plate;

the keyboard further includes:

a first locking groove formed in the first wall member;

a first slide groove formed in the first wall member, the first slide groove being connected to the first locking groove and extended toward the rotation rod;

a second locking groove formed in the second wall member;

a second slide groove formed in the second wall member, the second slide groove being connected to the second locking groove and extended toward the rotation rod;

a first locking member having a projection and a shaft connected to the projection, the projection being slidably arranged within the first locking groove and the shaft being slidably arranged in the first slide groove;

a second locking member having a projection and a shaft connected to the projection, the projection being slidably arranged within the second locking groove and the shaft being slidably arranged in the second slide groove;

a first spring arranged in the first locking groove, the first spring pressing the shaft of the first locking member toward the rotation rod;

a second spring arranged in the second locking groove, the second spring pressing the shaft of the second locking member toward the rotation rod;

wherein both end planes of the shafts of the first locking member and the second locking member contact with each other when the first and the second keyboard units are horizontally arranged, thereby the first and second keyboard units are made turnable in the horizontal direction, and wherein the projection of the first locking member is locked in the first locking groove and the projection of the second locking member is locked in the second locking groove when the first and second keyboard units are in a state other than a state that the first and second keyboard units are horizontally arranged, thereby the first and second keyboard units are inhibited from turning in the horizontal direction.

* * * * *